US012331441B2

(12) United States Patent
Ito

(10) Patent No.: US 12,331,441 B2
(45) Date of Patent: Jun. 17, 2025

(54) SEWING MACHINE

(71) Applicant: BROTHER KOGYO KABUSHIKI KAISHA, Nagoya (JP)

(72) Inventor: Kunihiro Ito, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 18/745,463

(22) Filed: Jun. 17, 2024

(65) Prior Publication Data

US 2024/0337054 A1 Oct. 10, 2024

Related U.S. Application Data

(63) Continuation of application No. PCT/JP2023/002040, filed on Jan. 24, 2023.

(30) Foreign Application Priority Data

Jan. 31, 2022 (JP) ..... 2022-013492

(51) Int. Cl.
*D05B 21/00* (2006.01)
*D05B 19/08* (2006.01)
(Continued)

(52) U.S. Cl.
CPC ..... *D05B 21/002* (2013.01); *D05B 19/08* (2013.01); *D05B 19/14* (2013.01); *D05B 19/16* (2013.01); *D05C 5/02* (2013.01); *D05D 2205/18* (2013.01)

(58) Field of Classification Search
CPC ..... D05B 19/02; D05B 19/08; D05B 19/12; D05B 19/14; D05B 19/16; D05B 21/002; D05B 35/12; D05C 5/02
See application file for complete search history.

(56) References Cited

U.S. PATENT DOCUMENTS 6,247,420 B1 * 6/2001 Chan ..... D05B 19/08 700/138
8,219,237 B2 * 7/2012 Schweizer ..... D05B 3/02 700/138

(Continued)

FOREIGN PATENT DOCUMENTS

JP 2019-058411 A 4/2019
JP 2020-005694 A 1/2020
JP 2020-018473 A 2/2020

OTHER PUBLICATIONS

Apr. 11, 2023 International Search Report issued in International Patent Application No. PCT/JP2023/002040.

*Primary Examiner* — Danny Worrell
(74) *Attorney, Agent, or Firm* — Oliff PLC

(57) ABSTRACT

A controller of a sewing machine acquires sewing data for forming a utility pattern continuously in a first direction, acquires a condition for sewing a tapering pattern including a tapering portion, generates a projection image representing the tapering pattern based on the sewing data and the condition, controls a needle bar, a feed dog, and an actuator in accordance with the sewing data to sew the utility pattern continuously in the first direction, after starting sewing of the utility pattern, controls a projector to project the projection image at a planned sewing position of the tapering pattern in a planned sewing size, and performs a tapering pattern sewing operation of, after starting projection of the projection image, controlling the needle bar, the feed dog, and the actuator in accordance with the sewing data and the condition to sew the tapering pattern that is continuous with the utility pattern.

12 Claims, 12 Drawing Sheets

(51) Int. Cl.

| | |
|---|---|
| ***D05B 19/14*** | (2006.01) |
| ***D05B 19/16*** | (2006.01) |
| ***D05C 5/02*** | (2006.01) |

(56) References Cited

U.S. PATENT DOCUMENTS

| | | | | |
|---|---|---|---|---|
| 10,626,533 | B2 * | 4/2020 | Yamanashi | D05B 19/08 |
| 11,047,080 | B2 * | 6/2021 | Kongo | D05B 19/10 |
| 11,060,221 | B2 * | 7/2021 | Minematsu | D05B 35/12 |
| 2008/0022910 | A1 | 1/2008 | Schweizer | |
| 2014/0182499 | A1 * | 7/2014 | Matsushima | D05B 19/12 700/137 |
| 2015/0128835 | A1 * | 5/2015 | Naka | D05B 19/12 112/102.5 |
| 2015/0128837 | A1 * | 5/2015 | Okuyama | D05B 19/10 700/137 |
| 2019/0093267 | A1 | 3/2019 | Yamanashi | |
| 2020/0010991 | A1 | 1/2020 | Minematsu et al. | |
| 2020/0040499 | A1 | 2/2020 | Kongo | |
| 2020/0308745 | A1 * | 10/2020 | Yamanashi | D05B 19/12 |
| 2022/0064834 | A1 * | 3/2022 | Minematsu | D05C 9/04 |

* cited by examiner

SEWING MACHINE

REFERENCE TO RELATED APPLICATIONS

This is a Continuation Application of International Application No. PCT/JP2023/002040 filed on Jan. 24, 2023, which claims priority from Japanese Patent Application No. 2022-013492 filed on Jan. 31, 2022. The entire content of each of the prior applications is incorporated herein by reference.

BACKGROUND ART

A sewing machine that generates and sews a tapering pattern is known.

SUMMARY

In a case where it is difficult to measure a length of a portion where stitches are formed, such as a curved portion, or in a case where a sewing workpiece expands or contracts, it may be difficult for a sewing machine to form a tapering pattern at a position intended by a user.

In view of the foregoing, an example of an object of this disclosure is to provide a sewing machine configured to improve a possibility of forming a tapering pattern at a position intended by a user.

According to one aspect, this specification discloses a sewing machine. The sewing machine includes a bed, a projector, a needle bar, an actuator, and a controller. The bed includes a needle plate. The bed is configured such that a sewing workpiece is placed thereon. The projector is configured to project a projection image toward the bed. The needle bar is configured that a sewing needle is attachable to a lower end of the needle bar. The needle bar is movable up and down to form stitches on the sewing workpiece. The feed dog is configured to feed the sewing workpiece in a first direction relative to the needle bar. The actuator is configured to move the needle bar relative to the needle plate in a second direction crossing the first direction. The controller is configured to acquire sewing data for forming a utility pattern continuously in the first direction. The utility pattern includes stitches crossing the first direction. Thus, the sewing machine acquires the sewing data. The controller is configured to acquire a condition for sewing a tapering pattern including a tapering portion. The tapering portion is obtained by deforming the utility pattern to be tapered toward one side in the first direction. Thus, the sewing machine acquires the condition. The controller is configured to generate the projection image representing the tapering pattern, based on the sewing data and the condition. Thus, the sewing machine generates the projection image. The controller is configured to control the needle bar, the feed dog, and the actuator in accordance with the sewing data to sew the utility pattern continuously in the first direction. Thus, the sewing machine sews the utility pattern. The controller is configured to, after starting sewing of the utility pattern, control the projector to project the projection image at a planned sewing position of the tapering pattern in a planned sewing size. Thus, the sewing machine projects the projection image at the planned sewing position in the planned sewing size. The controller is configured to perform a tapering pattern sewing operation of, after starting projection of the projection image, controlling the needle bar, the feed dog, and the actuator in accordance with the sewing data and the condition to sew the tapering pattern that is continuous with the utility pattern. Thus, the sewing machine sews the tapering pattern. The sewing machine of this aspect projects the projection image representing the tapering pattern at the planned sewing position on the sewing workpiece in the planned sewing size after sewing of the utility pattern is started. Thus, the user of the sewing machine grasps the planned sewing position and the size of the tapering pattern before the start of sewing of the tapering pattern after the start of sewing of the utility pattern. The projection control of the sewing machine contributes to reducing a possibility that the tapering pattern is sewn at a position that is not intended by the user.

DESCRIPTION

Embodiments of the present disclosure will be described with reference to the drawings. A physical configuration of a sewing machine 1 will be described with reference to FIGS. 1 to 3. An upper-lower direction, a lower right side, an upper left side, a lower left side, and an upper right side in FIG. 1 correspond to an upper-lower direction, a front, a rear, a left, and a right of the sewing machine 1, respectively. A longitudinal direction of a bed 11 and an arm 13 is the left-right direction of the sewing machine 1. The side on which a column (pillar) 12 is disposed is the right side. An extending direction of the column 12 is the upper-lower direction of the sewing machine 1.

Figure 1:
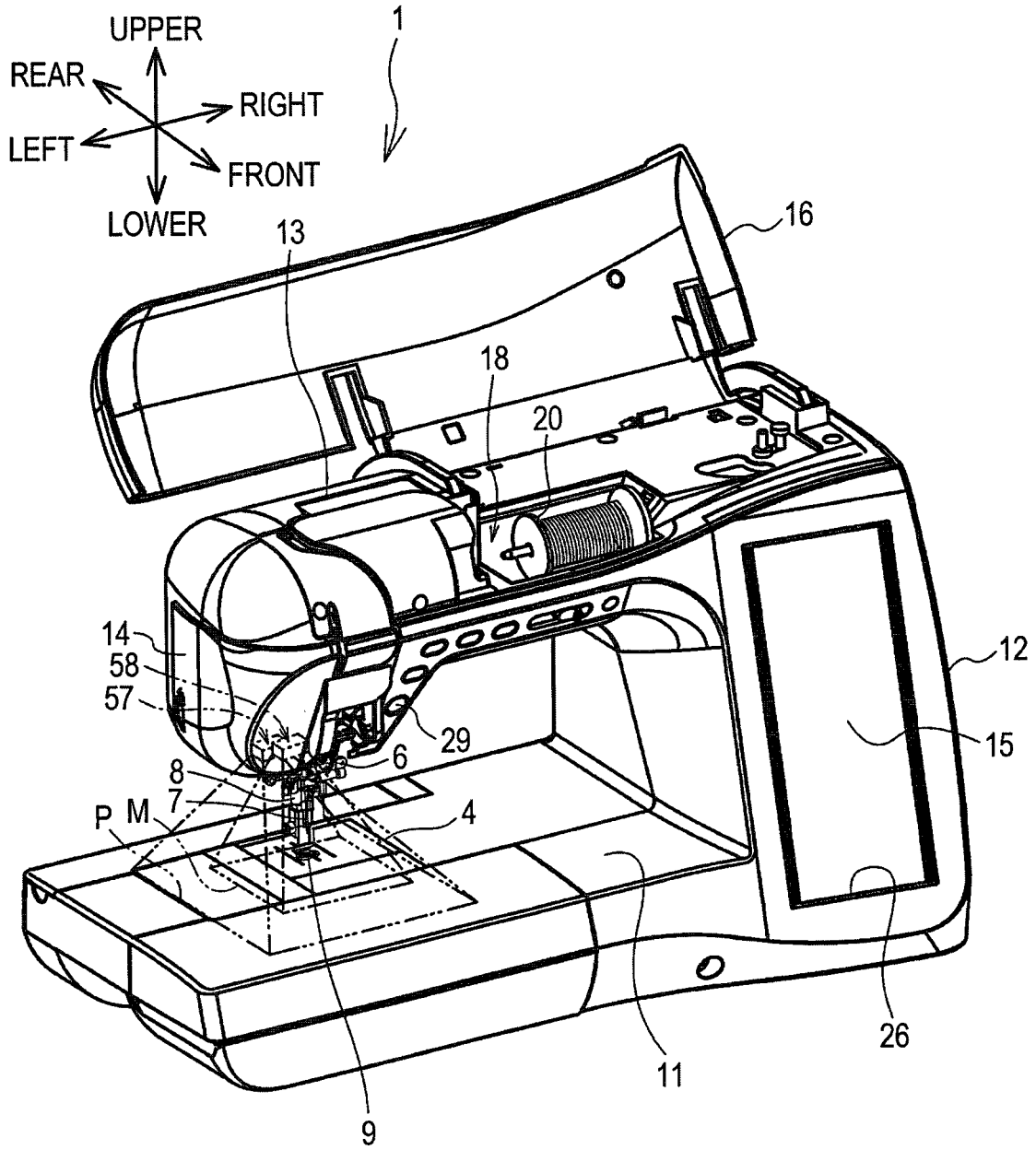
FIG. 1 is a perspective view of a sewing machine 1.

As shown in FIG. 1, the sewing machine 1 includes the bed 11, the column 12, the arm 13, and a head 14. The bed 11 is a base portion of the sewing machine 1 that extends in the left-right direction. The column 12 is erected upward from a right end of the bed 11. The arm 13 extends leftward from an upper end of the column 12 so as to face the bed 11. The head 14 is a portion connected to a left end of the arm 13.

Figure 6:
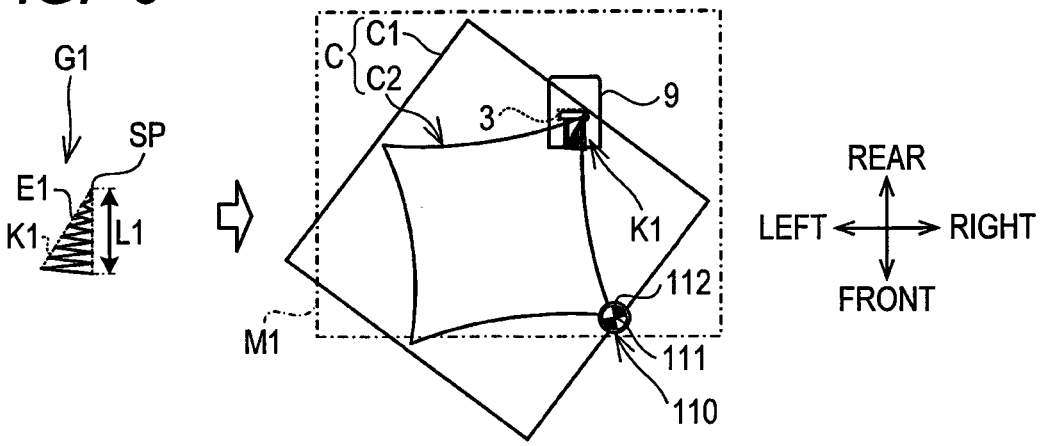
FIG. 6 is an explanatory diagram of a projection image M1 representing a start point portion G1.

A needle plate 4 is provided on an upper surface of the bed 11. The needle plate 4 has a needle hole 3 (see FIG. 6) through which a sewing needle 7 described later is inserted. The sewing machine 1 is provided with a feeder 32 shown in FIG. 3, a hook mechanism (not shown), and so on, in the bed 11. The feeder 32 has a feed dog 24 (see FIG. 3)

provided on the bed 11, and is configured to drive the feed dog 24 to feed a sewing workpiece C (see FIG. 6). The feed dog 24 is driven by a feed mechanism 23 (see FIG. 3), and feeds the sewing workpiece C by a particular feed amount. The feeder 32 of the present example is configured to drive the feed dog 24 and feed the sewing workpiece C in the front-rear direction (feed direction) and the left-right direction (movement direction). The hook mechanism intertwines an upper thread (not shown) with a lower thread (not shown) below the needle plate 4.

An LCD 15 is provided on the front surface of the column 12. The LCD 15 displays an image including various items such as a command, an illustration, a setting value, and a message. A touch panel 26 for detecting a pressed position is provided on the front side of the LCD 15. When the user performs a pressing operation on the touch panel 26 using a finger or a stylus pen (not shown), the touch panel 26 detects the pressed position. A controller 2 (see FIG. 3) of the sewing machine 1 recognizes the selected item in the image based on the detected pressed position. Hereinafter, the pressing operation of the touch panel 26 by the user is referred to as a panel operation. By the panel operation, the user selects a pattern including a utility pattern and a decorative pattern to be sewn, a command to be executed, and so on. The column 12 includes a sewing machine motor 33 (see FIG. 3) therein.

A cover 16 configured to open and close is provided on an upper portion of the arm 13. FIG. 1 shows a state in which the cover 16 is opened. A thread housing portion 18 is provided below the cover 16 (that is, inside the arm 13) in a state where the cover 16 is closed. The thread housing portion 18 is configured to house a thread spool 20 around which an upper thread is wound. A main drive shaft 34 (see FIG. 3) extending in the left-right direction is provided inside the arm 13. The main drive shaft 34 is rotationally driven by the sewing machine motor 33. Various switches including a start-stop switch 29 are provided at a lower left portion of the front surface of the arm 13. The start-stop switch 29 is used to start or stop the operation of the sewing machine 1, that is, to input an instruction to start or stop sewing.

Figure 2:
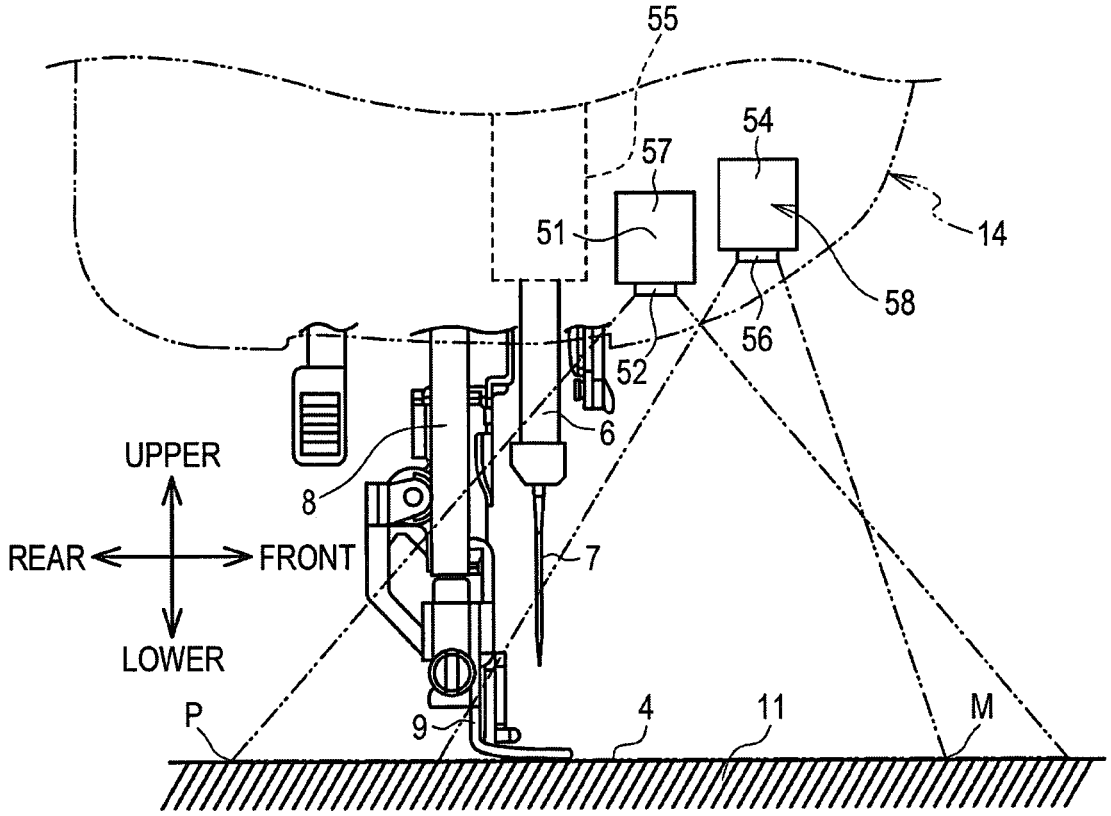
FIG. 2 is an explanatory view showing a configuration of a lower end portion of a head 14.
Figure 3:
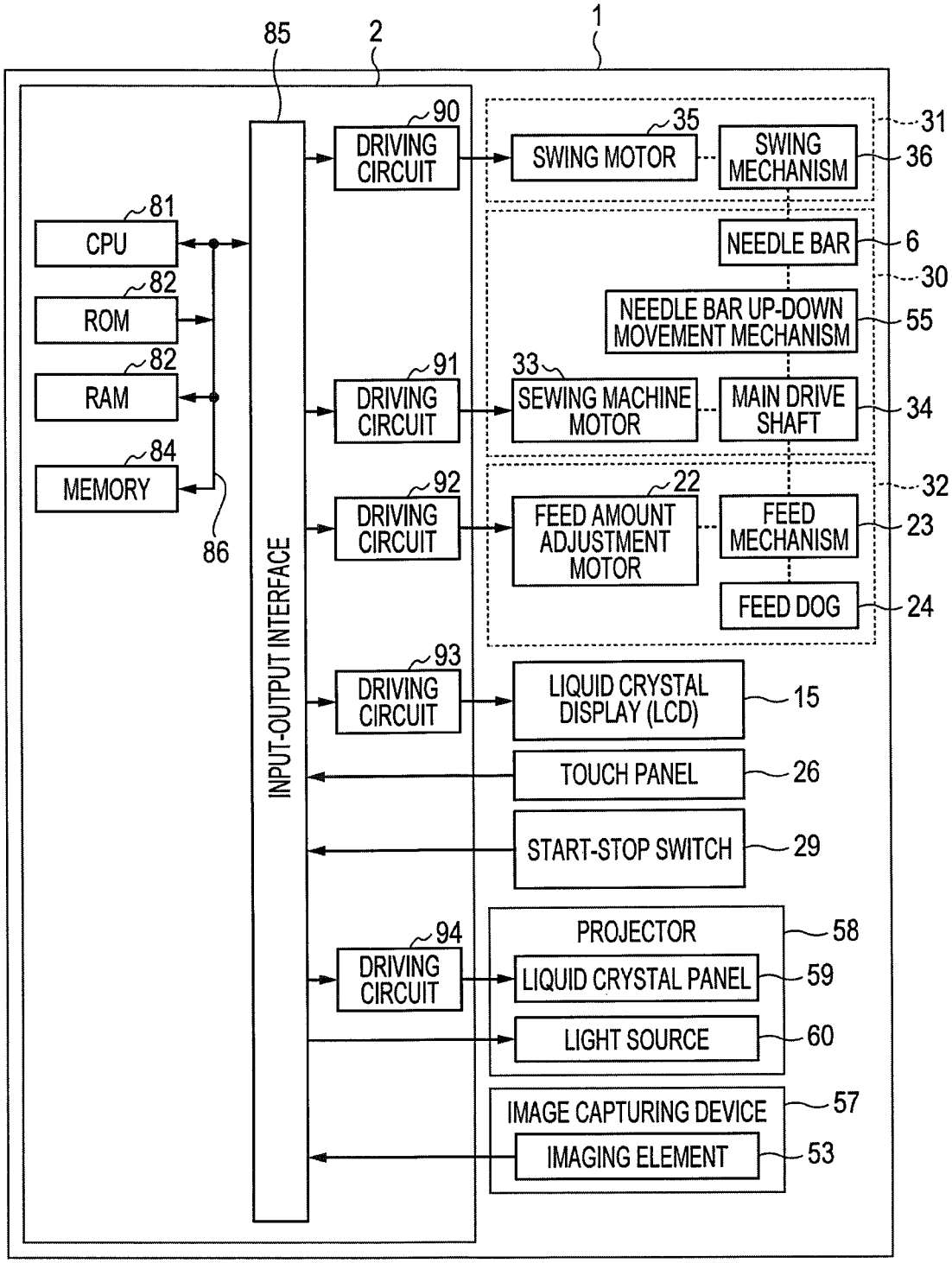
FIG. 3 is a block diagram showing an electrical configuration of the sewing machine 1.

As shown in FIGS. 2 and 3, the head 14 is provided with a sewing portion 30, a presser bar 8, a movement portion 31, a projector 58, an image capturing device (image sensor) 57, and so on. The sewing portion 30 includes a needle bar 6, the sewing machine motor 33, the main drive shaft 34, and a needle bar up-down movement mechanism 55, and is configured to move the needle bar 6 up and down by the power of the sewing machine motor 33 to form a stitch on the sewing workpiece C. The needle bar 6 is located above the needle hole 3. The sewing needle 7 is detachably attached to a lower end of the needle bar 6. The needle bar up-down movement mechanism 55 drives the needle bar 6 in the upper-lower direction by the rotation of the main drive shaft 34. A presser foot 9 is detachably attached to a lower end of the presser bar 8. The presser foot 9 is movable, together with the presser bar 8, between a lowered position where the presser foot 9 presses the sewing workpiece C and a raised position where the presser foot 9 is retracted upward from the lowered position (away from the sewing workpiece C). The presser foot 9 intermittently presses the sewing workpiece C downward in conjunction with the up-down movement of the needle bar 6.

The movement portion 31 includes a swing motor (actuator) 35 and a swing mechanism 36, and is configured to cause the needle bar 6 to swing in the left-right direction with respect to the needle plate 4 by the power of the swing motor 35. The center position of the swing range of the needle bar 6 in the right-left direction by the swing mechanism 36 is referred to as a center baseline position, and the left end and right end of the swing range of the needle bar 6 are respectively referred to as a left baseline position and right baseline position. The width of the swing range in the left-right direction may be appropriately set in accordance with the configuration of the swing mechanism 36. For example, the width of the swing range in the left-right direction is 7 mm, the width from the left baseline position to the center baseline position in the left-right direction is 3.5 mm, and the width from the center baseline position to the right baseline position in the left-right direction is 3.5 mm.

The projector 58 is configured to project a projection image onto a rectangular projection region M that is long in the left-right direction and includes the needle hole 3 formed below the needle bar 6 on the bed 11. The projector 58 includes a cylindrical housing 54, a liquid crystal panel 59 (see FIG. 3), a light source 60 (see FIG. 3), and an imaging lens 56 which are accommodated in the housing 54. The housing 54 is fixed to a machine frame in the head 14. The light source 60 is an LED. The liquid crystal panel 59 modulates light from the light source 60, and forms image light of a projection image based on image data representing the projection image. The imaging lens 56 forms an image of the image light formed by the liquid crystal panel 59 in the projection region M on the bed 11. Since the projector 58 of the present example projects the projection image onto the sewing workpiece C on the bed 11 from obliquely above, the projection image is subjected to a process of correcting distortion of the image. The size of the projection region M of the projector 58 of the present example (for example, the number of dots of the long side and the short side of the rectangular range) is stored in a memory (storage) 84 in advance. The long side of the projection region M on the bed 11 is approximately 12.7 cm, and the short side is approximately 7.6 cm.

The image capturing device 57 is provided inside the head 14. The image capturing device 57 is, for example, a known CMOS image sensor. The image capturing device 57 is configured to capture a particular capturing region P including the projection region M. The capturing region P includes a region below the needle bar 6. The long side of the capturing region P on the bed 11 is approximately 8.8 cm, and the short side is approximately 4.8 cm. The image capturing device 57 includes a box-shaped housing 51, a lens 52, and an imaging element 53 shown in FIG. 3. The housing 51 is fixed to the machine frame in the head 14. The lens 52 is provided on the lower surface of the housing 51. The imaging element 53 is accommodated in the housing 51. The imaging element 53 is configured to detect light incident from the capturing region P through the lens 52 and generate image data obtained by capturing the capturing region P.

An electrical configuration of the sewing machine 1 will be described with reference to FIG. 3. The controller 2 of the sewing machine 1 includes a CPU 81, a ROM 82, a RAM 83, the memory 84, and an input-output interface (I/O) 85. The CPU 81 is connected to the ROM 82, the RAM 83, the memory 84, and the input-output interface 85 via a bus 86.

The CPU 81 performs main control of the sewing machine 1, and performs various types of computation and processing relating to sewing in accordance with various types of programs stored in the ROM 82. Although not shown, the ROM 82 includes a plurality of storage areas including a program storage area. The program storage area stores various programs for operating the sewing machine 1 (for example, a program for performing a main process described later).

The RAM 83 includes a storage area for storing calculation results and so on obtained by calculation processing by the CPU 81. The memory 84 stores various parameters and so on for the sewing machine 1 to perform various types of processing. The memory 84 stores sewing data for sewing utility patterns that can be sewn by the sewing machine 1 in association with pattern IDs for respective ones of a plurality of utility patterns. Each of the plurality of utility patterns is sewn by continuously arranging, in the feed direction, a pattern in which a plurality of line segments including a line segment crossing the feed direction of the sewing workpiece C by the feeder 32 are combined. That is, the feed direction of the sewing workpiece C by the feeder 32 is a direction in which patterns representing a utility pattern are continuously arranged, and in the present example, is a direction perpendicular to the longitudinal direction of the bed 11 on the upper surface of the bed 11. The direction in which the patterns are continuously arranged is also referred to as a forming direction of a utility pattern or a tapering pattern. In a case where the orientation of the sewing workpiece C with respect to the needle bar 6 is adjusted by the user, the forming direction of the sewn pattern is a direction that crosses the front-rear direction.

The sewing data includes coordinate data. The coordinate data is data in which coordinates of needle drop points at which a plurality of stitches forming a utility pattern are formed are represented by relative positions with respect to a reference position of the utility pattern. The reference position is, for example, a baseline position that is determined in accordance with the range of movement of the needle bar 6 in the left-right direction by the swing mechanism 36, and the position of the needle bar 6 in the left-right direction when the sewing needle 7 first pierces the sewing workpiece C (that is, the first needle). The baseline position is, for example, one of the center baseline position, the left baseline position, and the right baseline position. The relative positions of the center baseline position, the left baseline position, and the right baseline position are stored in the memory 84 in advance. Thus, regardless of which baseline position is used as the reference position, the controller 2 identifies the relative position with respect to the center baseline position. The coordinate data in this example includes a data group representing a plurality of relative coordinates with respect to the center baseline position for each needle drop point.

Each of the plurality of utility patterns is a pattern that is sewn by controlling the sewing portion 30 and the feeder 32 in accordance with the sewing data and appropriately changing the position of the needle bar 6 in the left-right direction by the movement portion 31. When the sewing machine 1 sews the utility pattern in accordance with the sewing data, the sewing machine 1 performs a process of feeding the sewing workpiece C in the front-rear direction with respect to the needle bar 6 by driving the feeder 32 to feed the sewing workpiece C in the feed direction. When the sewing machine 1 sews the utility pattern in accordance with the sewing data, the sewing machine 1 may perform a process of moving the sewing workpiece C in the left-right direction with respect to the needle bar 6 by driving the movement portion 31 to change the position of the needle bar 6 in the left-right direction with respect to the needle plate 4, or may perform the process by driving the feeder 32 to move the sewing workpiece C in the left-right direction (the movement direction), or may perform the process by a combination of both. The pattern ID is an identifier for identifying a plurality of utility patterns, and is a number in the present example.

The memory 84 of the present example further stores a coordinate system of the projector 58 (hereinafter also referred to as a "projection coordinate system"), a coordinate system of an image represented by image data generated by the image capturing device 57 (hereinafter also referred to as an "image coordinate system"), and a coordinate system of the entire space (hereinafter, also referred to as a "world coordinate system"). These coordinate systems are associated with one another in advance by parameters stored in the memory 84. Thus, the sewing machine 1 performs a process of specifying the coordinates in the projection coordinate system based on the sewing data and a process of specifying the coordinates in the world coordinate system based on the image data. The projection image in this example is a color image of a plurality of colors. However, the projection image may be a monochrome image, or the color of the projection image may be adjustable in accordance with the color, the pattern, and so on of the sewing workpiece C.

Driving circuits 90, 91, 92, 93 and 94 included in the controller 2, the touch panel 26, the start-stop switch 29, the light source 60 of the projector 58, and the image capturing device 57 are connected to the input-output interface 85. The light source 60 is turned on in accordance with a control signal from the CPU 81, and projects the projection image displayed on the liquid crystal panel 59 onto the sewing workpiece C fed on the bed 11 by the feed dog 24.

The swing motor 35 is connected to the driving circuit 90. The driving circuit 90 drives the swing motor 35 in accordance with a control signal from the CPU 81. The sewing machine motor 33 is connected to the driving circuit 91. The driving circuit 91 drives the sewing machine motor 33 in accordance with a control signal from the CPU 81. As the sewing machine motor 33 is driven, the needle bar up-down movement mechanism 55 is driven via the main drive shaft 34 of the sewing machine 1, and the needle bar 6 moves up and down. A feed amount adjustment motor 22 is connected to the driving circuit 92. The driving circuit 93 displays an image on the LCD 15 by driving the LCD 15 in accordance with a control signal from the CPU 81. The driving circuit 94 drives the liquid crystal panel 59 of the projector 58 in accordance with a control signal from the CPU 81 to display a projection image on the liquid crystal panel 59.

The main process of the sewing machine 1 will be described with reference to FIGS. 4A to 9. In the main process, processing for sewing a tapering pattern is performed in accordance with an instruction from the user. The tapering pattern is a pattern including a tapering portion obtained by deforming a utility pattern so as to be tapered toward one side in the feed direction of the feed dog 24 (that is, the front-rear direction). The main process is started when the user inputs, on the screen 70 shown in FIG. 5, a starting instruction to start the main process by a panel operation after inputting an instruction to select a utility pattern to be a source of a tapering portion and a tapering condition described later. In response to detecting the starting instruction, the controller 2 reads out the program for performing the main process stored in the program storage area of the ROM 82 to the RAM 83. The controller 2 performs the following steps in accordance with instructions included in the program read out to the RAM 83. Various parameters required for performing the main process are stored in the memory 84. Various kinds of data obtained in the course of the main process are appropriately stored in the RAM 83.

In the following description, various types of image data to be processed by the controller 2 are simply referred to as an image, a captured image, or a projection image. In order to simplify the description, it is assumed that the coordinates of the world coordinate system representing the size of the pattern and the relative positions of the stitches forming the pattern are the same as the coordinates of the projection coordinate system. The upper-lower direction and the left-right direction in FIGS. 6 to 9 correspond to the front-rear direction and the left-right direction of the sewing machine 1. As a specific example, as shown in FIG. 6, a case where a square fabric C2 is sewn to a square fabric C1 with a tapering pattern TP (see FIG. 8) along the contour of the fabric C2 is used. The fabric C2 is smaller than the fabric C1. Each side of the contour of the fabric C2 has a curved shape that is convex toward the center of the fabric C2. The fabrics C1 and C2 are also collectively referred to as the sewing workpiece C.

Figure 4A:
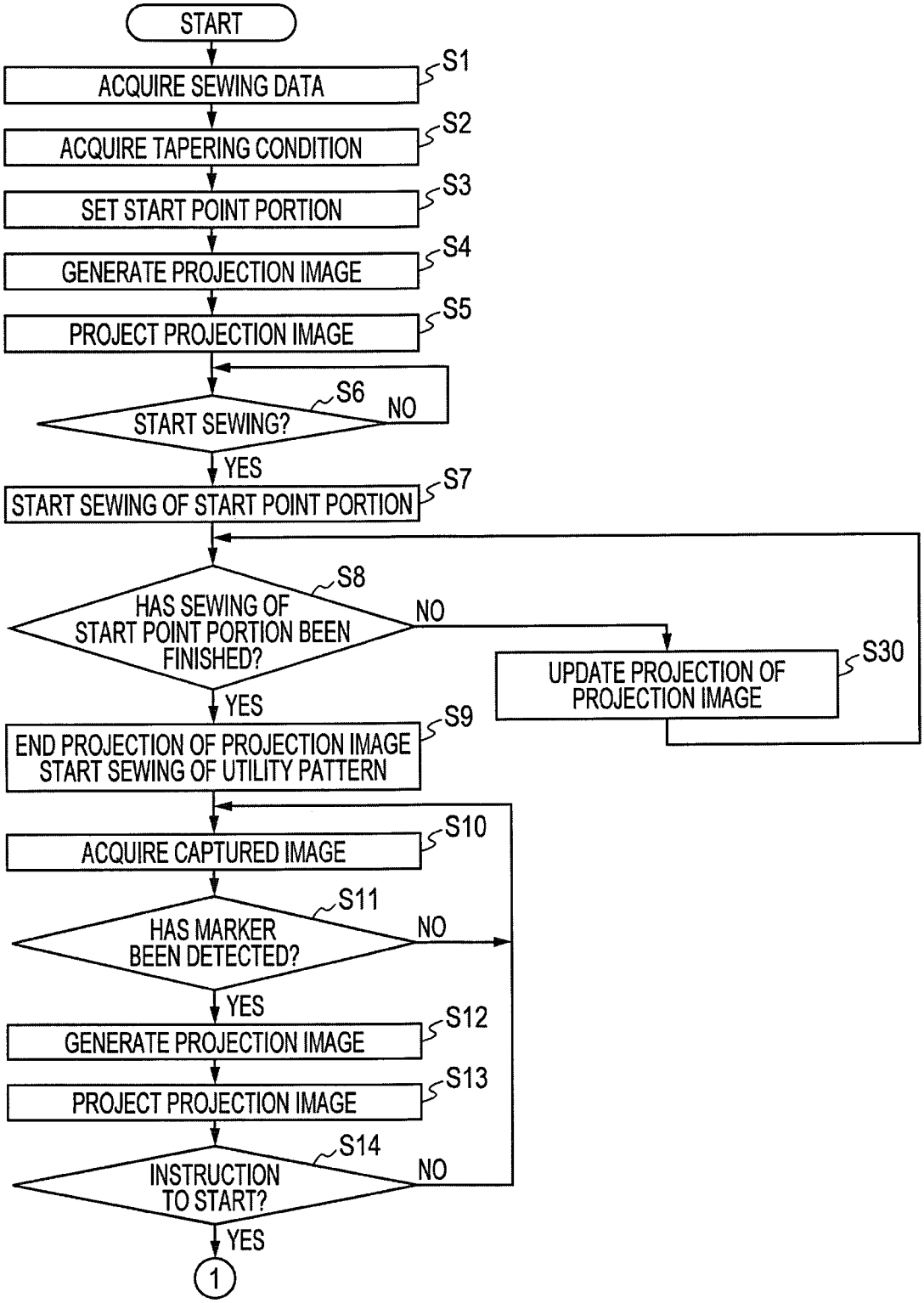
FIGS. 4A and 4B show a flowchart of a main process.
Figure 4B:
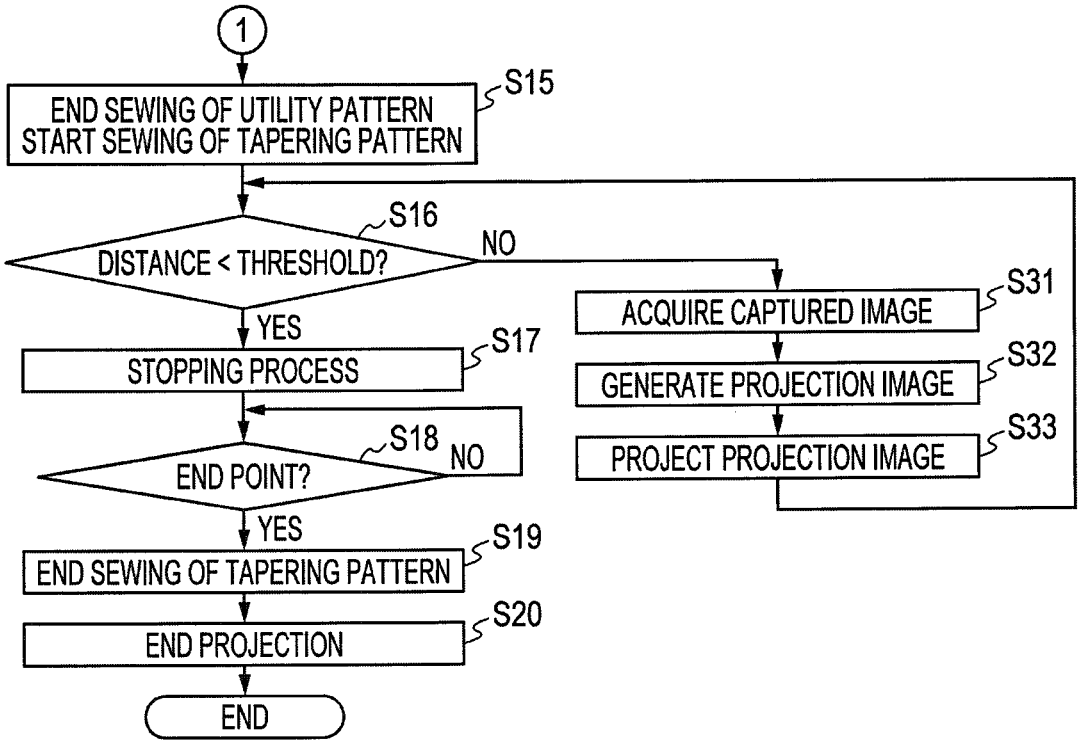
Figure 5:
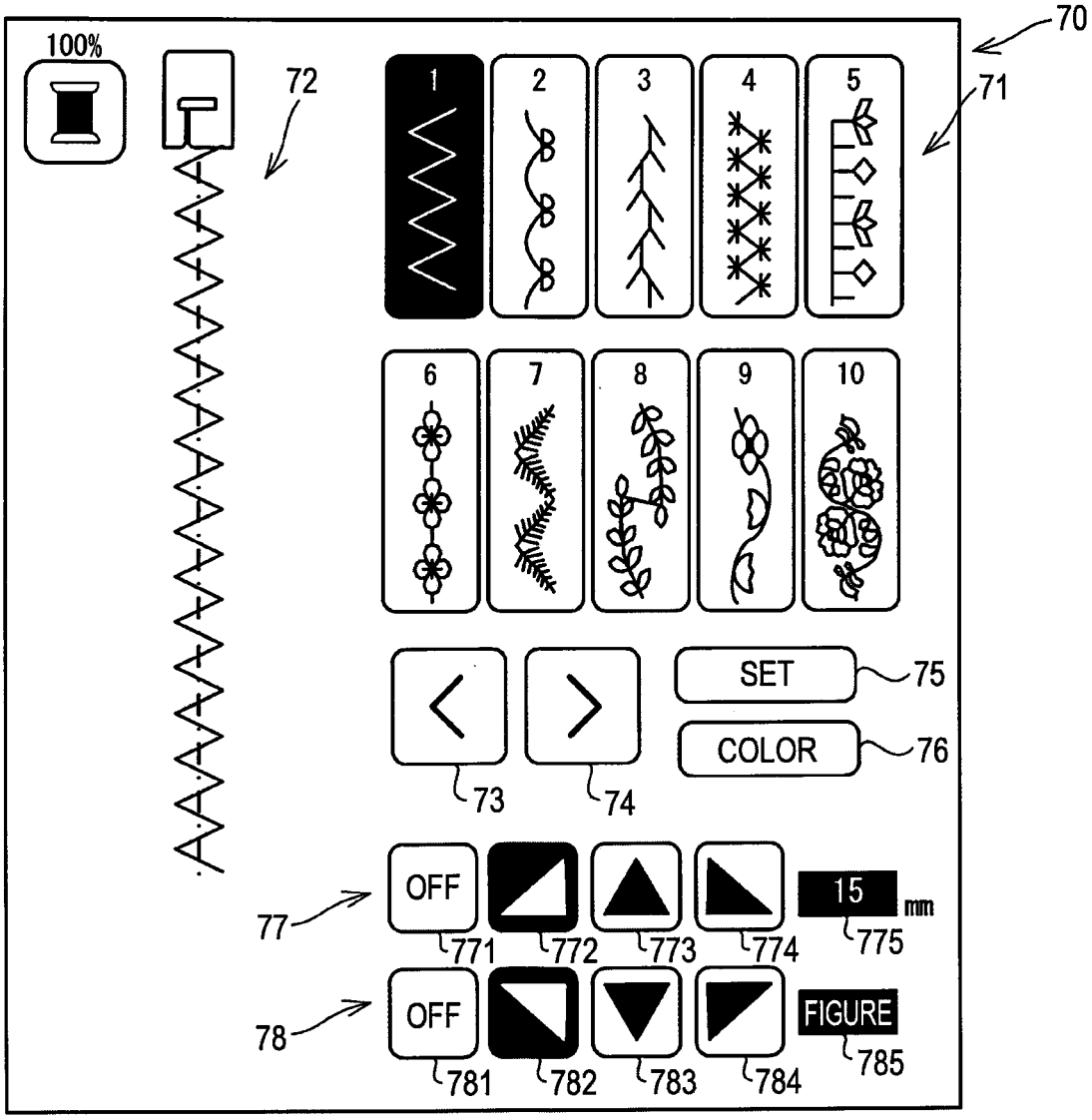
FIG. 5 is an explanatory diagram of a screen 70 displayed in the main process.

As shown in FIGS. 4A and 4B, the controller 2 acquires sewing data of the utility pattern selected by the user (S1). Before inputting a starting instruction, the user inputs, on the screen 70 shown in FIG. 5, an instruction to select a utility pattern which is a source of a tapering portion, and a tapering condition described later. As shown in FIG. 5, the screen 70 includes display fields 71 and 72, input keys 73, 74, 75 and 76, and condition input fields 77 and 78. In the display field 71, sewing images of a particular number of (for example, ten) utility patterns among the plurality of types of utility patterns stored in the memory 84 are displayed together with the numbers of the pattern IDs of the utility patterns, in the order of the pattern IDs. When the sewing image of one utility pattern is selected from among the sewing images of the plurality of types of utility patterns displayed in the display field 71, the background of the sewing image of the utility pattern is displayed in a color different from that of the utility patterns that have not been selected. The display field 72 indicates the sewing image of the selected utility pattern. The screen 70 shows a case where the utility pattern of a zigzag pattern with the pattern ID of 1 is selected. The input key 73 is used to input an instruction to select the utility pattern having the pattern ID immediately before the pattern ID of the currently-selected utility pattern. The input key 74 is used to input an instruction to select the utility pattern having the pattern ID immediately after the pattern ID of the currently-selected utility pattern. The input key 75 is used to input an instruction to set the currently-selected utility pattern as a utility pattern to be sewn. The input key 76 is used to input an instruction to change the color of the utility pattern to be projected by the projector 58.

The condition input fields 77 and 78 are fields for inputting the tapering condition. The tapering condition is a condition for specifying the shape of the tapering portion. The tapering condition in the present example includes the shape of the tapering portion, the length of the tapering portion in the front-rear direction, and the mode of the projection image representing the tapering pattern including the tapering portion. The shape of the tapering portion is selected from three types of a right-tapered shape, a center-tapered shape, and a left-tapered shape. The right-tapered shape is a shape in which a tip deformed into a tapered shape, which is a front end or a rear end of the tapering portion, is located at a right end of the tapering portion. The center-tapered shape is a shape in which the tip of the tapering portion is located at the center of the tapering portion in the left-right direction. The left-tapered shape is a shape in which the tip of the tapering portion is located at the left end of the tapering portion. The mode of the projection image is selected from line segments representing the stitches of the tapering pattern and a figure indicating the formation range of the stitches of the tapering pattern. The line segments and the figure represent the tapering pattern in different modes (preview modes).

The condition input field 77 is a field for setting the tapering condition of the tapering portion to be formed at a start point portion at which sewing of the tapering pattern is started. The condition input field 77 includes input keys 771, 772, 773 and 774 and an input field 775. The input key 771 is used to input an instruction to perform sewing in accordance with the sewing data of the utility pattern without setting a tapering portion at the start point portion. The input key 772 is used to specify the right-tapered shape as the shape of the tapering portion. The input key 773 is used to specify the center-tapered shape as the shape of the tapering portion. The input key 774 is used to specify the left-tapered shape as the shape of the tapering portion. Among the input keys 771 to 774, the selected condition is displayed in a color different from that of the unselected conditions. The screen 70 shows a state in which the input key 772 is selected among the input keys 771 to 774. The input field 775 is used to specify the length of the start point portion in the feed direction by the feed dog 24.

Similarly, the condition input field 78 is a field for setting the tapering condition of the tapering portion to be formed at an end point portion at which the sewing of the tapering pattern is finished. The condition input field 78 includes input keys 781, 782, 783 and 784 and a selection field 785. The screen 70 shows a state in which the input key 782 is selected among the input keys 781 to 784. The selection field 785 is a field for selecting the mode of the projection image representing the tapering pattern. The mode of the projection image representing the tapering pattern of the present example is selected from among the projection image representing a figure indicating the formation range of the stitches of the tapering pattern and the projection image representing line segments indicating the stitches of the tapering pattern. The screen 70 shows a state in which the projection image representing the figure indicating the formation range of the stitches is selected as the mode of the projection image representing the tapering pattern. The condition input field 78 of the present example does not include an input field similar to the input field 775, but the condition input field 78 may include an input field for inputting the length of the end point portion in the feed direction.

The controller 2 acquires sewing data of a zigzag pattern selected on the screen 70 from the memory 84 (S1). The controller 2 acquires a tapering condition based on the condition input fields 77 and 78 of the screen 70 (S2). Based on the condition input fields 77 and 78 of the screen 70, the controller 2 acquires the shape of the tapering portion and the length of the tapering portion in the front-rear direction as the tapering condition of the start point portion, and acquires the shape of the tapering portion and the mode of the projection image as the tapering condition of the end point portion. The controller 2 sets a start point portion G1 in FIG. 6 based on the sewing data acquired in S1 and the tapering condition acquired in S2 (S3). The start point portion may be set by appropriately using a known method based on the sewing data and the tapering condition. In a case where the input key 771 is selected on the screen 70 of FIG. 5 and it is instructed not to set the tapering portion at the start point portion by the tapering condition acquired in S2, the controller 2 may omit the processing from S3 to S8. As shown in FIG. 6, the start point portion G1 is a zigzag-pattern stitch E1 having needle drop points on sides of a triangle K1 having a starting point SP as a vertex. The number of stitches per unit distance in the feed direction (a thread density in the feed direction) of the start point portion G1 is the same as the number of stitches per unit distance in the feed direction of the zigzag pattern. The starting point SP is located at the right rear end of the triangle K1. The start point portion G1 is tapered rearward. A length L1 of the start point portion G1 in the front-rear direction is 15 mm which is set based on the tapering condition acquired in S2.

The controller 2 generates a projection image M1 representing the tapering pattern based on the sewing data acquired in S1 and the tapering condition acquired in S2 (S4). The controller 2 uses parameters of the various coordinate systems stored in the memory 84 to generate a projection image for projecting the start point portion G1 set in S3 at a planned sewing position of the start point portion G1 on the sewing workpiece C placed on the bed 11 in a planned sewing size of the start point portion G1. The planned sewing size of the start point portion G1 is the size of the stitch E1 formed based on the start point portion G1 set in S3. The projection image M1 is obtained, for example, by converting the triangle K1 indicating the formation range of the stitch E1 represented in the world coordinate system into coordinates represented in the projection coordinate system, based on sewing data of the start point portion G1. Since the stitch E1 formed on the sewing workpiece C may shrink depending on the sewing condition, the size of the start point portion G1 represented by the projection image does not need to be exactly the same as the size of the actually sewn start point portion G1, and may have a difference of approximately 0 to 10% with respect to the size of the actually sewn start point portion G1. The projection image M1 of the present example represents a tapering portion, that is, a tapering pattern including only the start point portion G1.

The controller 2 controls the projector 58 to project the projection image M1 generated in S4 at the planned sewing position of the tapering pattern in the planned sewing size (S5). At a position where the rear end of the start point portion G1 is below the needle bar 6, the controller 2 controls the projector 58 to project the projection image M1 representing the triangle K1 at the planned sewing position of the start point portion G1 in the planned sewing size. Based on the projection image M1 projected on the upper surface of the sewing workpiece C and the upper surface of the presser foot 9, the user checks the sewing position, shape, and size of the start point portion G1, adjusts the position and angle of the sewing workpiece C with respect to the needle bar 6 as necessary, and then operates the start-stop switch 29 to input an instruction to start sewing.

The controller 2 waits until the controller 2 detects an instruction to start sewing that is output from the start-stop switch 29 (S6: NO). In response to detecting an instruction to start sewing (S6: YES), the controller 2 drives the sewing portion 30, the feeder 32, and the movement portion 31 in accordance with the sewing data of the start point portion G1 set in S3 to start sewing of the start point portion G1 (S7). The controller 2 determines whether sewing of the start point portion G1 has been finished based on the number of stitches that have been sewn from the sewing start of the start point portion G1 and the number of stitches of the start point portion G1 (S8). In a case where the number of stitches from the start of the sewing is smaller than the number of stitches of the start point portion G1 (S8: NO), the controller 2 updates the projection image in accordance with the feed amount of the sewing workpiece C by the feed dog 24 from the start of the sewing, and projects the updated projection image at the planned sewing position in the planned sewing size (S30). By the processing of S30, the controller 2 of the present example updates the projection image in conjunction with the relative movement of the sewing workpiece C with respect to the needle bar 6. In a case where the number of stitches from the start of the sewing of the start point portion G1 is equal to the number of stitches of the start point portion G1 (S8: YES), the controller 2 controls the projector 58 to end the projection of the start point portion G1. With the end point of the start point portion G1 as a start point, the controller 2 starts to sew the utility pattern based on the sewing data that is acquired in S1, that is, the zigzag pattern (S9). In a case where the input key 781 is selected on the screen 70 of FIG. 5 and it is instructed not to set a tapering portion at the end point portion by the tapering condition acquired in S2, the controller 2 may omit the subsequent processes and perform a process of sewing a normal utility pattern.

The controller 2 acquires a captured image generated by the image capturing device 57 (S10). The controller 2 may acquire a particular range in an image generated by the image capturing device 57 as the captured image. The controller 2 performs image processing on the captured image acquired in S10 and determines whether a marker 110 is detected in the captured image (S11). The marker 110 is used by the user to indicate the formation position of the front end of the end point portion on the sewing workpiece C. The marker 110 includes a graphic 112 drawn in black on the upper surface of a white circular sheet. The sheet is, for example, circular with a diameter of approximately 1.0 cm. The graphic 112 includes a circle and cross-shaped line segments passing through a center point 111 of the circle. Of the four regions defined by the circle and the line segments, two regions facing each other with respect to the center point 111 are black, and the remaining two regions are white. The center point 111 represents the position of the front end of the end point portion specified by the user. When indicating the position of the front end of the end point portion using the marker 110, the user affixes the marker 110 to a desired position on the upper surface of the sewing workpiece C.

The shape of the marker 110 is stored in the memory 84. The detection of the marker 110 and determination of the coordinates thereof are performed using a known method. Specifically, the controller 2 determines the center point 111 of the marker 110 by using, for example, the result of the Hough transform processing and the shape of the marker 110 stored in the memory 84, and calculates the two-dimensional coordinates of the center point 111 in the image coordinate system. After that, the controller 2 converts the two-dimensional coordinates of the image coordinate system into three dimensional coordinates of the world coordinate system.

In a case where the marker 110 is not detected from the captured image (S11: NO), the controller 2 returns the processing to S10. In a case where the marker 110 is detected from the captured image (S11: YES), the controller 2 generates a projection image representing a tapering pattern based on the sewing data acquired in S1 and the tapering condition acquired in S2 (S12). The tapering pattern may be set by appropriately using a known method based on the sewing data and the tapering condition. The controller 2 sets the length of the tapering pattern in the front-rear direction in accordance with the distance between the current needle drop point and the center point 111 of the marker 110 detected in S11. A method of determining the position of the current needle drop point may be appropriately determined. The front-rear position of the needle drop point with respect to the needle plate 4 in the present example is constant, and the controller 2 acquires the front-rear position of the needle drop point with respect to the needle plate 4 stored in the memory 84. The left-right position of the needle drop point with respect to the needle plate 4 is changed by the movement portion 31. The controller 2 determines the left-right position of the needle drop point with respect to the needle plate 4 based on the movement amount of the needle bar 6 by the movement portion 31.

Figure 7:
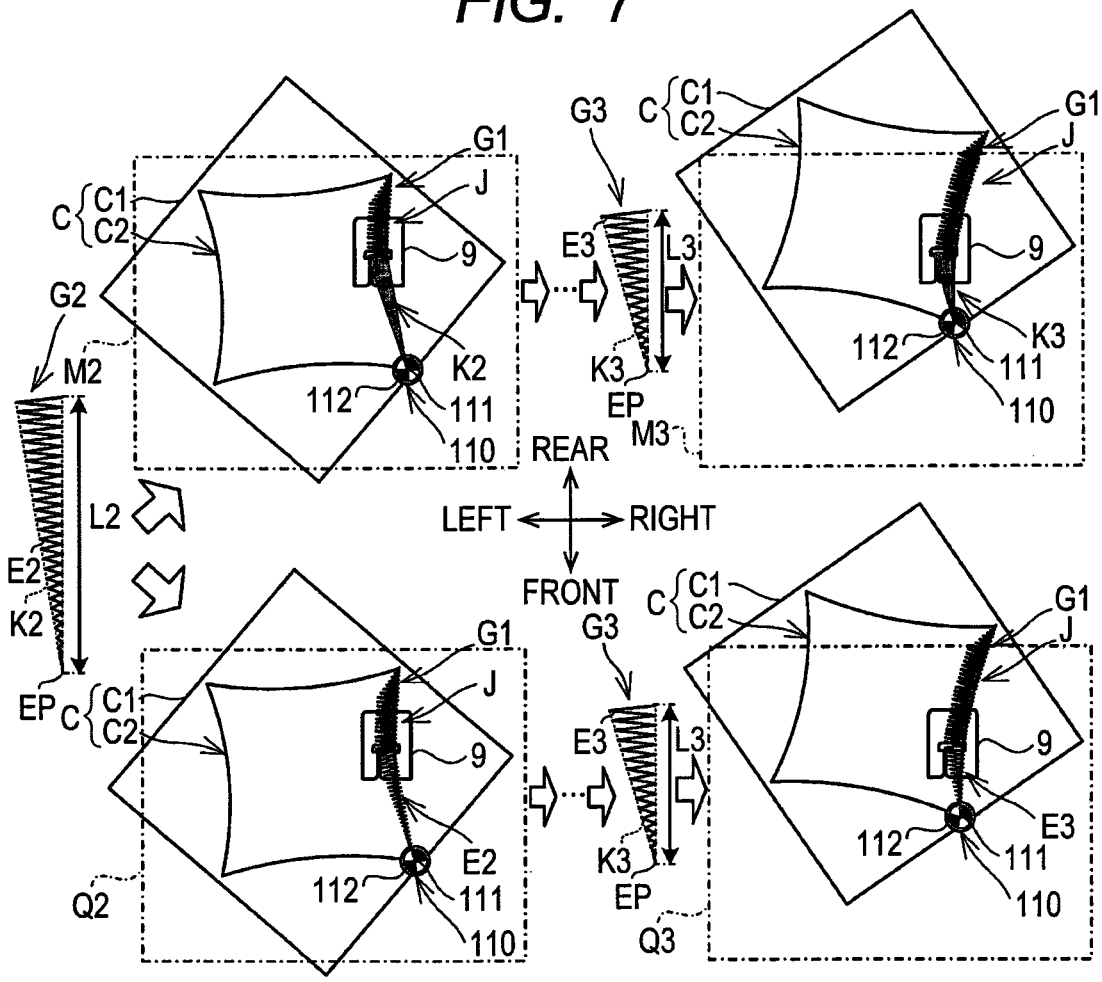
FIG. 7 is an explanatory diagram of projection images M2 and Q2 representing an end point portion G2 and projection images M3 and Q3 representing an end point portion G3.

Specifically, as shown in FIG. 7, the controller 2 sets the end point portion G2 based on the sewing data acquired in S1 and the tapering condition acquired in S2, with the current needle drop point as the rear end of the end point portion G2 and the position of the center point 111 of the marker 110 as the front end of the end point portion G2. The end point portion G2 is a zigzag-pattern stitch E2 having needle drop points on sides of a triangle K2 having an end point EP as a vertex. The number of stitches per unit distance in the feed direction of the end point portion G2 (the thread density in the feed direction) is the same as the number of stitches per unit distance in the feed direction of a utility pattern J. The end point EP is located at a right front end of the triangle K2. The end point portion G2 is tapered forward. A length L2 in the formation direction of the end point portion G2 is the distance between the current needle drop point and the center point 111 of the marker 110. In consideration of a time lag from when the captured image is acquired to when the projection image is projected, the controller 2 may set the length L2 in the forming direction of the end point portion G2 to be shorter than the length between the current needle drop point and the center point 111 of the marker 110 by a particular length.

The contour of the fabric C2 is not linear but curved. A line segment that connects the current needle drop point and the center point 111 of the marker 110 crosses the front-rear direction, which is the feed direction of the sewing workpiece C by the feed dog 24. Thus, when sewing is performed on the end point portion G2 in which the position of the center point 111 of the marker 110 is the end point EP, the controller 2 inclines the forming direction of the end point portion G2 with respect to the front-rear direction, which is the feed direction by the feed dog 24, on the assumption that the user adjusts the orientation of the sewing workpiece C with respect to the needle bar 6. The controller 2 generates a projection image for projecting the set end point portion G2 at the planned sewing position of the end point portion G2 on the sewing workpiece C placed on the bed 11 in the mode specified in the selection field 785 of the screen 70, in the planned sewing size of the end point portion G2. The controller 2 controls the projector 58 to project the generated projection image at the planned sewing position of the tapering pattern in the planned sewing size (S13).

In the specific example, the controller 2 generates a projection image M2 representing the triangle K2 specified in the selection field 785 at a position where the rear end of the end point portion G2 is below the needle bar 6 and the front end of the end point portion G2 is the center point 111 of the marker 110 (S12), and projects the generated projection image M2 at the planned sewing position of the tapering pattern in the planned sewing size (S13). The right side of the triangle K2 extends in a direction crossing the front-rear direction. The rear end of the triangle K2 is arranged at the position of the current needle drop point. The front end of the triangle K2 is located at the center point 111 of the marker 110. In a case where a projection image including line segments representing the stitch E2 of the end point portion G2 is selected in the selection field 785, the controller 2 generates a projection image Q2 representing the stitch E2 specified in the selection field 785 (S12), and projects the generated projection image Q2 at the planned sewing position of the end point portion G2 in the planned sewing size (S13).

Based on the projection image M2 or Q2 projected on the upper surface of the sewing workpiece C, the user checks the sewing position, shape, size of the end point portion G2, and the orientation of the sewing workpiece C with respect to the needle bar 6, and operates the start-stop switch 29 at the timing of starting sewing of the end point portion G2 to input an instruction to start sewing. The controller 2 determines whether an instruction to start sewing is detected (S14). In response to not detecting an instruction to start the sewing (S14: NO), the controller 2 returns the processing to S10. In consideration of a time lag from when the controller 2 projects the projection image to when the user operates the start-stop switch 29, the controller 2 may reduce the sewing speed to a particular speed and perform the processing of S13.

By repeatedly performing the processing from S10 to S14, the projection image that is projected onto the sewing workpiece C is updated in accordance with the position of the marker 110 on the sewing workpiece C. For example, as shown in FIG. 7, the controller 2 generates a projection image M3 or a projection image Q3 representing the tapering pattern of the end point portion G3 based on the sewing data acquired in S1 and the tapering condition acquired in S2 (S12). The projection image Q3 includes line segments representing a stitch E3 of the end point portion G3, and the projection image M3 represents a triangle K3 indicating the formation range of the stitch E3. The end point portion G3 is formed in a direction substantially parallel to the front-rear direction. A length L3 in the formation direction of the end point portion G3 is shorter than the length L2 in the formation direction of the end point portion G2. The controller 2 controls the projector 58 to project the generated projection image M3 or projection image Q3 at the planned sewing position of the end point portion G3 in the planned sewing size (S13).

In response to detecting an instruction to start the sewing of the end point portion (S14: YES), the controller 2 ends the sewing of the utility pattern J and starts the sewing of the end point portion set in S12 (S15). The controller 2 sets an end point portion G4 by setting the current needle drop point as a starting point of the end point portion G4 (see FIG. 8) and setting the center point 111 of the marker 110 as an end point of the end point portion G4, and controls the sewing portion 30, the feeder 32, and the movement portion 31 to start sewing the set end point portion G4.

The controller 2 determines whether the distance from the needle drop point to the end point EP of the end point portion is smaller than a threshold (S16). As the threshold, a value smaller than the length of the end point portion G4 in the formation direction is appropriately set. The controller 2 may perform the processing of S16 by acquiring the captured image and calculating the distance on the captured image. The controller 2 may perform the processing of S16 based on the number of stitches after starting of sewing of the end point portion in S15 and on the feed amount of the sewing workpiece C in accordance with the number of stitches.

In a case where the distance from the needle drop point to the end point EP of the end point portion G4 is greater than or equal to the threshold (S16: NO), the controller 2 acquires the captured image output by the image capturing device 57 (S31). The controller 2 generates a projection image representing the end point portion G4 based on the position of the center point 111 of the marker 110 in the acquired captured image (S32), and controls the projector 58 to project the generated projection image (S33). The controller 2 returns the processing to S16. By performing the processing in S16 and S31 to S33, the controller 2 updates the projection image that is projected onto the sewing workpiece C in accordance with the position of the marker 110 on the sewing workpiece C.

In a case where the distance from the needle drop point to the end point EP of the end point portion G4 is smaller than the threshold (S16: YES), the controller 2 performs a stopping process (S17). In the stopping process, the controller 2 controls the sewing portion 30, the feeder 32, and the movement portion 31 to temporarily stop sewing of the end point portion G4, and displays a message for prompting the user to peel off (remove) the marker 110 from the sewing workpiece C on the LCD 15. The user peels off the marker 110 from the sewing workpiece C while the sewing of the end point portion is stopped, and then presses the start-stop switch 29 to instruct restart of the sewing of the end point portion G4. In response to detecting pressing of the start-stop switch 29, the controller 2 restarts the sewing of the end point portion G4.

The controller 2 determines whether the end point EP of the end point portion G4 has been sewn (S18). The controller 2 may perform the processing of S18 based on the number of stitches after starting the sewing of the end point portion G4 in S15 and on the feed amount of the sewing workpiece C in accordance with the number of stitches. The controller 2 may perform the processing of S18 based on the number of stitches from when the sewing of the end point portion G4 is restarted in S17 and on the feed amount of the sewing workpiece C in accordance with the number of stitches. In a case where the end point EP of the end point portion G4 has not been sewn (S18: NO), the controller 2 waits until the end point EP of the end point portion G4 is sewn. In a case where the end point EP of the end point portion G4 has been sewn (S18: YES), the controller 2 controls the sewing portion 30, the feeder 32, and the movement portion 31 to end the sewing of the end point portion G4. The controller 2 controls the projector 58 to end projection of the projection image (S20). The controller 2 then ends the main process.

Figure 8:
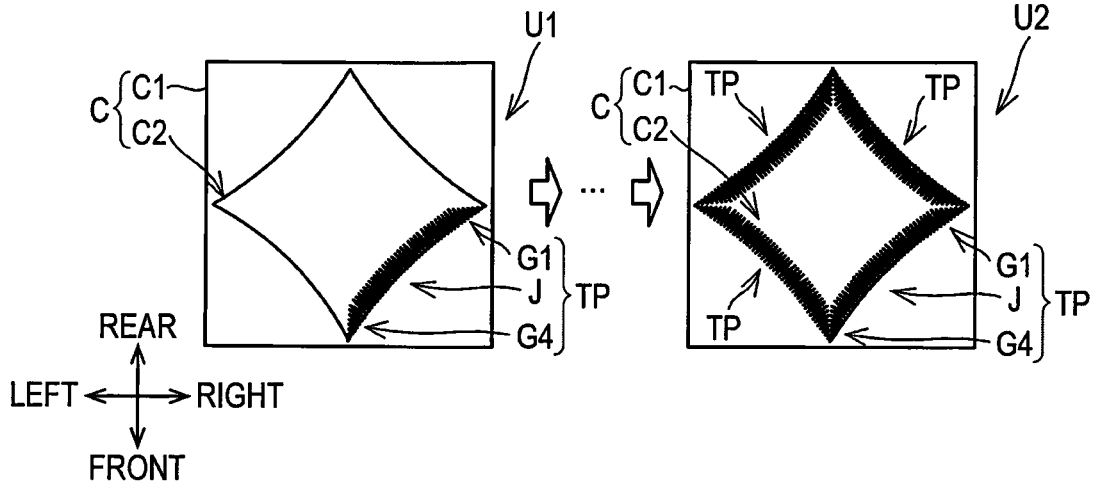
FIG. 8 is an explanatory diagram of a tapering pattern TP formed on a sewing workpiece C in states U1 and U2.

By the main process, as shown in a state U1 in FIG. 8, the tapering pattern TP of sewing one of the four sides of the fabric C2 to the fabric C1 is sewn. The tapering pattern TP includes the start point portion G1, the utility pattern J, and the end point portion G4. By performing the main process four times, as in a state U2, four tapering patterns TP, each of which sews one of the four sides of the fabric C2 to the fabric C1, are sewn. In the second and subsequent main processes, the processing of S1 and S2 may be omitted as appropriate.

In the first embodiment, the user checks a preview (projection image) projected on the sewing workpiece C, and presses the start-stop switch 29 at the timing when the end point portion G2 becomes a desired shape. The sewing of the end point portion G2 is started at the timing when the user presses the start-stop switch 29. The first embodiment provides a sewing machine configured to, while the utility pattern is being sewn, generate a preview image (projection image) in real time, which shows the shape of the end point portion G2 that will be sewn assuming that the start-stop switch 29 is pressed now to start sewing the end point portion G2, and project the preview image onto the sewing workpiece C by the projector. In conventional technique, it has been difficult to know the right timing to press the start-stop switch since there is no preview image.

Figure 9:
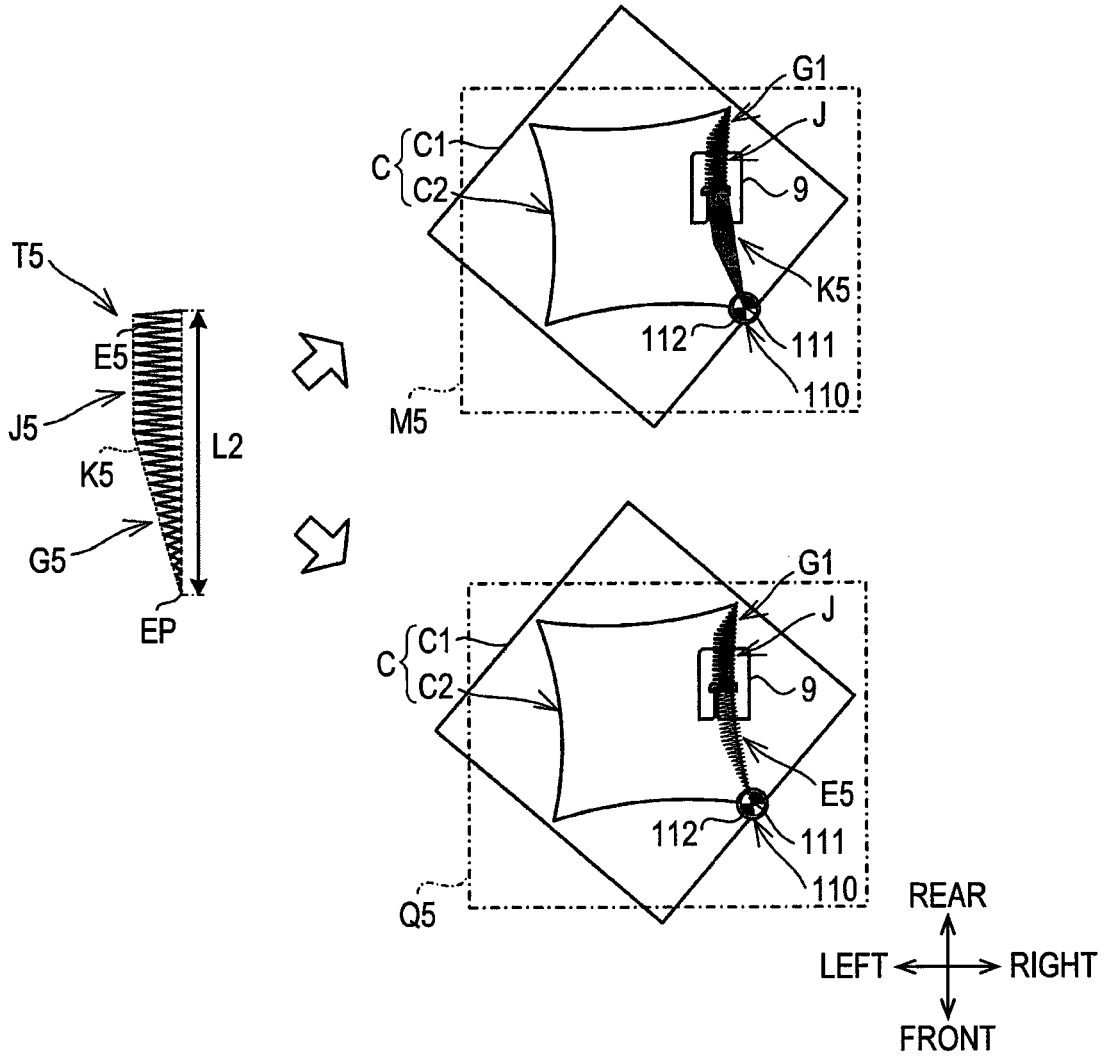
FIG. 9 is an explanatory diagram of projection images M5 and Q5 representing a tapering pattern T5.

A tapering pattern of the sewing machine 1 according to a first modification will be described with reference to FIG. 9. The tapering pattern represented by the projection image that is generated and projected by the sewing machine 1 of the first modification in S12, S13, S30, S32, and S33 includes, in addition to the tapering portion, a zigzag pattern that is a utility pattern that is sewn continuously with the tapering portion. In a specific example, the controller 2 sets a tapering pattern T5 in place of the end point portion G2 of the above embodiment. The tapering pattern T5 includes an end point portion G5 and a utility pattern J5 of a particular length. The particular length may be a predetermined length or may be a length obtained from a distance L2 between the needle drop point and the center point 111 of the marker 110. The controller 2 generates a projection image M5 for projecting a pentagon K5 specified in the selection field 785 at a position that the rear end of the tapering pattern T5 is located below the needle bar 6 and the front end of the tapering pattern T5 is located at the center point 111 of the marker 110 (S12). The controller 2 controls the projector 58 to project the generated projection image M5 at the planned sewing position of the tapering pattern T5 in the planned sewing size (S13). The right side of the pentagon K5 extends in a direction crossing the front-rear direction. The rear end of the pentagon K5 is arranged at the position of the current needle drop point. The front end of the pentagon K5 is arranged at the center point 111 of the marker 110. In a case where the projection image including line segments representing a stitch E5 of the tapering pattern T5 is selected in the selection field 785, the controller 2 generates a projection image Q5 representing the stitch E5 (S12), and projects the generated projection image Q5 at the planned sewing position of the tapering pattern T5 in the planned sewing size (S13).

Figure 10A:
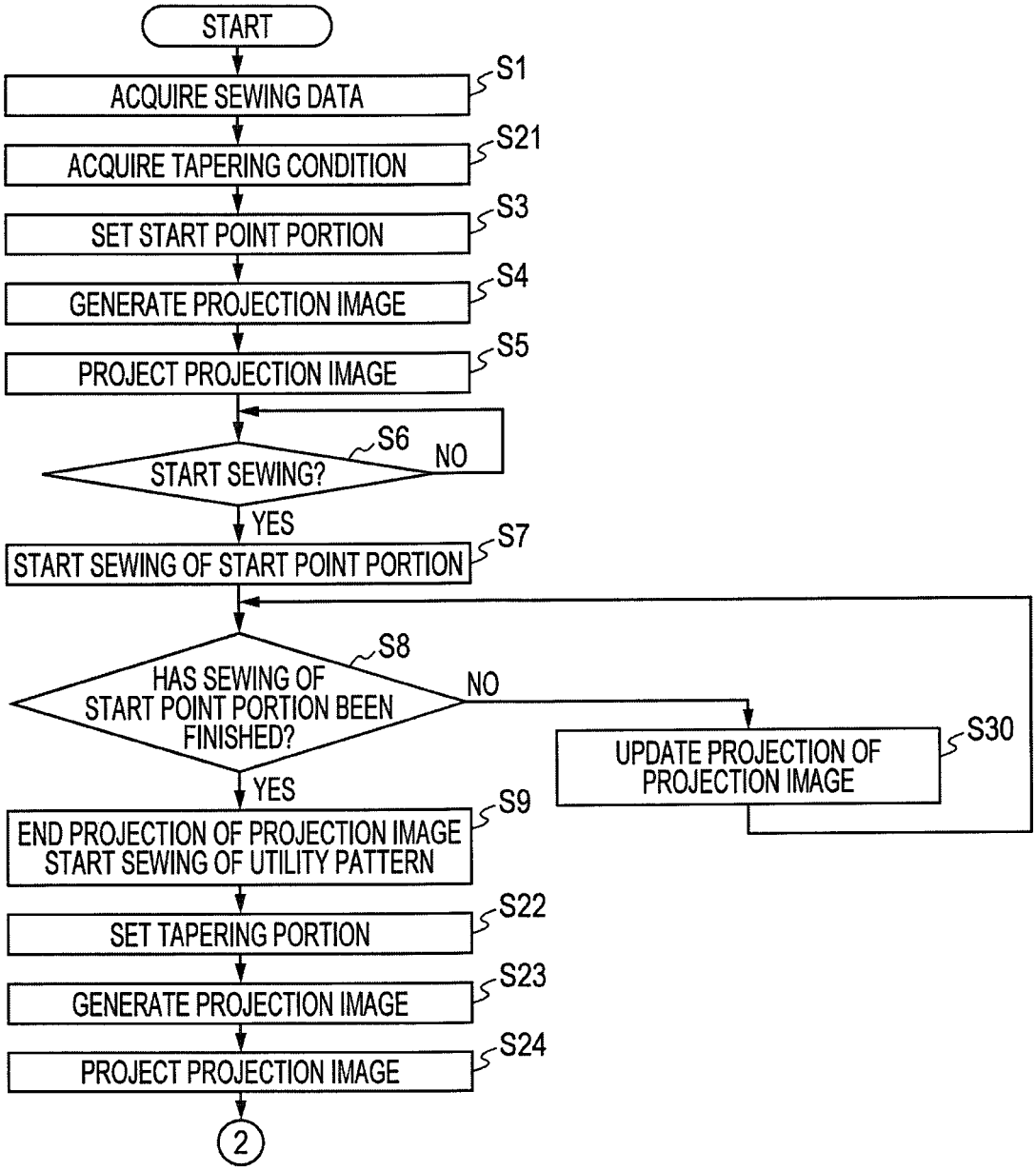
FIGS. 10A and 10B show a flowchart of a main process.
Figure 10B:
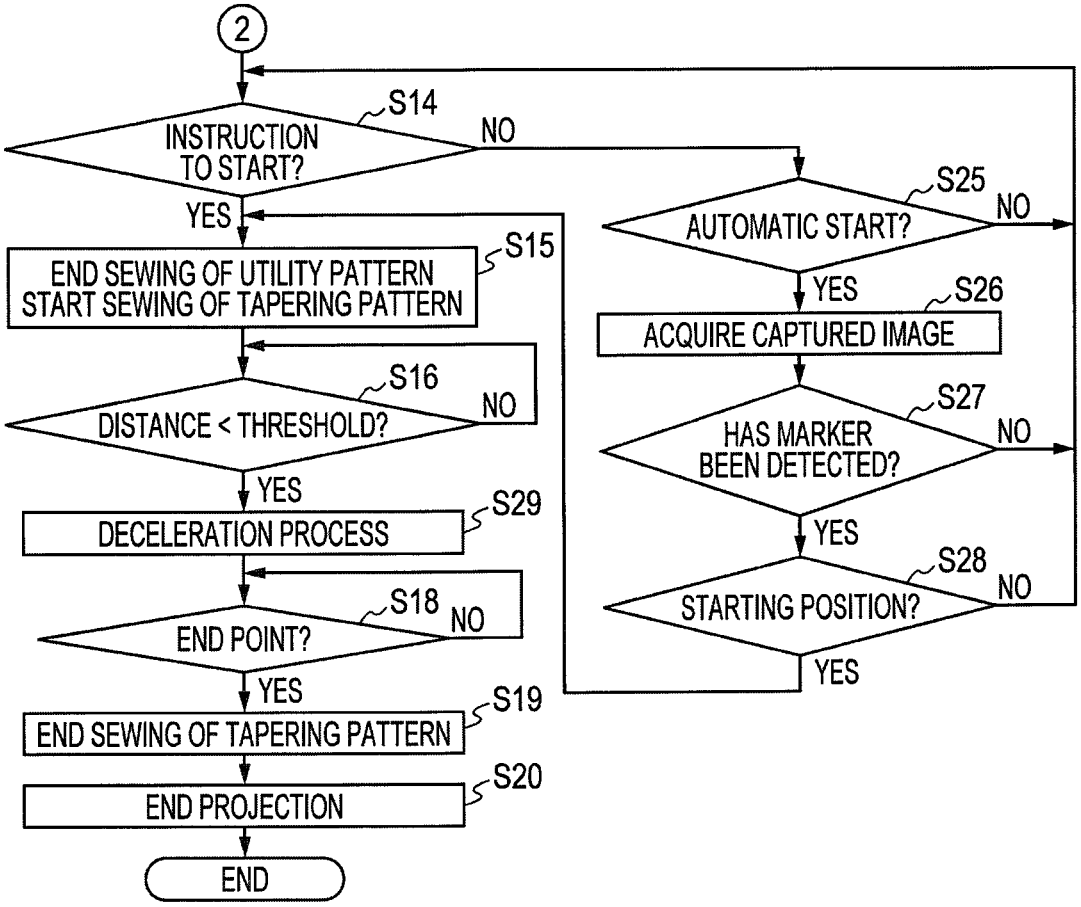

A main process of the sewing machine 1 according to a second modification will be described with reference to FIGS. 10A, 10B and 11. In FIGS. 10A and 10B, the same processes as those in the main process of the embodiment in FIGS. 4A and 4B are denoted by the same reference numerals. As shown in FIGS. 10A and 10B, the main process of the second modification is different from the main process of the embodiment in that the processing of S21 is performed instead of the processing of S2, the processing of S22 to S24 is performed instead of the processing of S10 to S13, the processing of S25 to S28 is performed between the processing of S14 and S15, the processing of S31 to S33 is omitted, and the processing of S29 is performed instead of the processing of S17. Hereinafter, a description of the same processing as the main process of the embodiment of FIGS. 4A and 4B will be omitted, and processing different from the main process of the embodiment will be described.

As shown in FIGS. 10A and 10B, in S21, the controller 2 acquires a tapering condition based on condition input fields 77 and 78 similar to those on the screen 70 in FIG. 5 (S21). Although not shown, the condition input field 78 of the second modification includes, in addition to the conditions of the embodiment, the length of the end point portion in the forming direction, and whether to automatically determine the timing to start sewing of the end point portion. In S22, the controller 2 sets an end point portion G6 shown in FIG. 11 as a tapering portion based on the sewing data acquired in S1 and the tapering condition acquired in S2 (S22).

Figure 11:
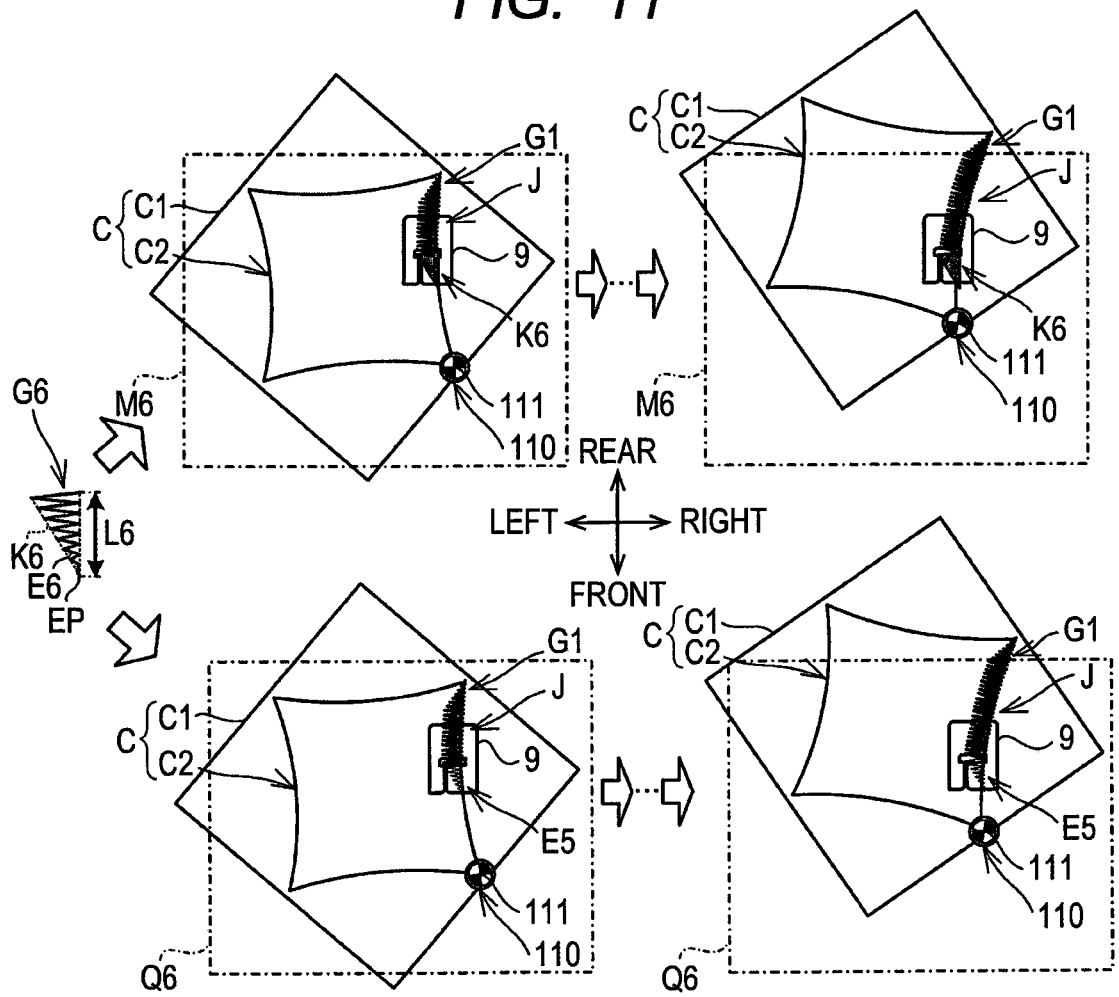
FIG. 11 is an explanatory diagram of projection images M6 and Q6 when an end point portion G6 is set.
Figure 12:
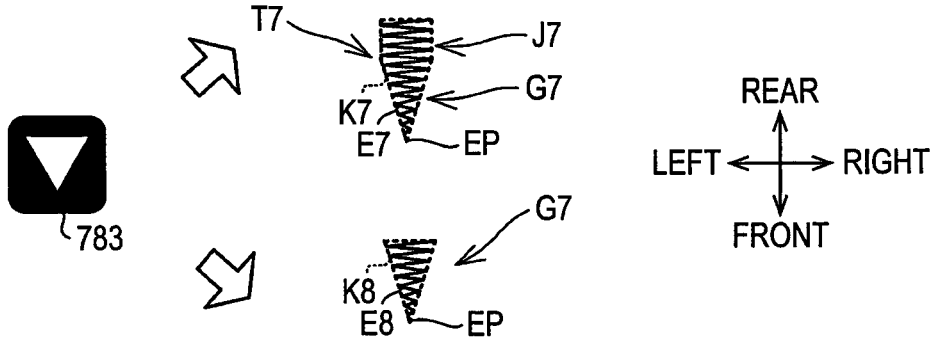
FIG. 12 is an explanatory diagram of a tapering pattern T7 and an end point portion G7 when an input key 783 is selected.

As shown in FIG. 11, the controller 2 sets the length in the forming direction of the end point portion G6 to a length L6 in the forming direction of the end point portion included in the tapering condition. The controller 2 generates a projection image M6 or Q6 for projecting the end point portion G6 set in S22 at the planned sewing position of the end point portion G6 on the sewing workpiece C placed on the bed 11 in the planned sewing size of the end point portion G6, while setting the position of the current needle drop point as the rear end of the end point portion G6 and in the mode specified in the selection field 785 of the screen 70 (S23). The controller 2 maintains the forming direction of the end point portion G6 in the front-rear direction, which is the feed direction of the sewing workpiece C by the feed dog 24. The controller 2 controls the projector 58 to project the projection image M6 or Q6 generated in S23 at the planned sewing position of the end point portion G6 in the planned sewing size (S24). The rear end of the end point portion G6 is projected to the position of the current needle drop point. The right side of the end point portion G6 extends in the front-rear direction. In a case where the projection image including line segments representing a stitch E6 of the end point portion G6 is selected in the selection field 785, the controller 2 generates the projection image Q6 representing the stitch E6 (S23), and projects the generated projection image Q6 at the planned sewing position of the end point portion G6 in the planned sewing size (S24). The controller 2 may not update the projection image M6 or Q6 in accordance with the feed of the sewing workpiece C until an instruction to start the sewing of the end point portion G6 is detected. Until an instruction to start the sewing of the end point portion G6 is detected, the controller 2 may update the projection image M6 or Q6 depending on whether the current needle drop point is the right-side needle drop point of the zigzag pattern or the left-side needle drop point of the zigzag pattern.

In response to not detecting an instruction to start sewing of the end point portion (S14: NO), the controller 2 determines whether it is set to automatically determine the timing to start sewing of the end point portion based on the condition acquired in S21 (S25). In a case where it is not set to automatically determine the timing to start sewing of the end point portion (S25: NO), the controller 2 returns the processing to S14. In a case where it is set to automatically determine the timing to start sewing of the end point portion (S25: YES), the controller 2 acquires a captured image output by the image capturing device 57 (S26). The controller 2 determines whether the marker 110 is detected from the captured image acquired in S25 by a process similar to that in S11 of the embodiment (S27). In response to not detecting the marker 110 (S27: NO), the controller 2 returns the processing to S14.

In response to detecting the marker 110 (S27: YES), the controller 2 determines whether the current position of the sewing workpiece C with respect to the needle bar 6 is the position at which the sewing of the end point portion G6 is to be started, based on the detected position of the center point 111 of the marker 110 (S28). For example, in a case where the distance from the current needle drop point to the center point 111 of the marker 110 is equal to the length of the end point portion in the formation direction acquired by S21, the controller 2 determines that the current position is the position at which the sewing of the end point portion G6 is to be started. In consideration of a time lag from when the captured image is acquired to when the sewing of the end point portion G6 is started, the controller 2 may determine that the current position is the position at which the sewing of the end point portion G6 is to be started, when a difference between the distance from the current needle drop point to the center point 111 of the marker 110 and the length of the end point portion in the forming direction acquired in S21 becomes smaller than a particular value. In a case where the current position of the sewing workpiece C with respect to the needle bar 6 is not the position at which the sewing of the end point portion G6 is to be started (S28: NO), the controller 2 returns the processing to S14. In a case where the current position of the sewing workpiece C with respect to the needle bar 6 is the position at which the sewing of the end point portion G6 is to be started (S28: YES), the controller 2 performs the processing of S15 as in the embodiment.

In a case where the distance from the needle drop point to the end point EP of the end point portion G6 is smaller than the threshold in S16 (S16: YES), the controller 2 performs a deceleration process (S29). In the deceleration process, the controller 2 controls the sewing portion 30, the feeder 32, and the movement portion 31 to decelerate the sewing speed of the end point portion G6 to a particular speed, and displays a message on the LCD 15 to prompt the user to peel off the marker 110 from the sewing workpiece C. The user refers to the message and peels off the marker 110 from the sewing workpiece C. The controller 2 may receive an instruction to return the sewing speed to the original speed from the user and return the sewing speed to the speed before the deceleration after the deceleration process.

In the second modification, in a case where the input key 783 is selected among the input keys 781 to 784 on the screen 70, a tapering pattern T7 including a utility pattern J7 and an end point portion G7, or the end point portion G7 is set in S22. The length of the utility pattern J7 in the formation direction in the tapering pattern T7 may be a particular length or a length obtained based on the length of the end point portion G7. When generating a projection image representing the tapering pattern T7, the controller 2 generates a projection image representing line segments representing a stitch E7 of the tapering pattern T7 or a pentagon K7 representing the formation range of the stitch E7 (S23). When generating a projection image representing the end point portion G7, the controller 2 generates a projection image representing line segments representing a stitch E8 of the end point portion G7 or an isosceles triangle K8 representing the formation range of the stitch E8 (S23).

Figure 13:
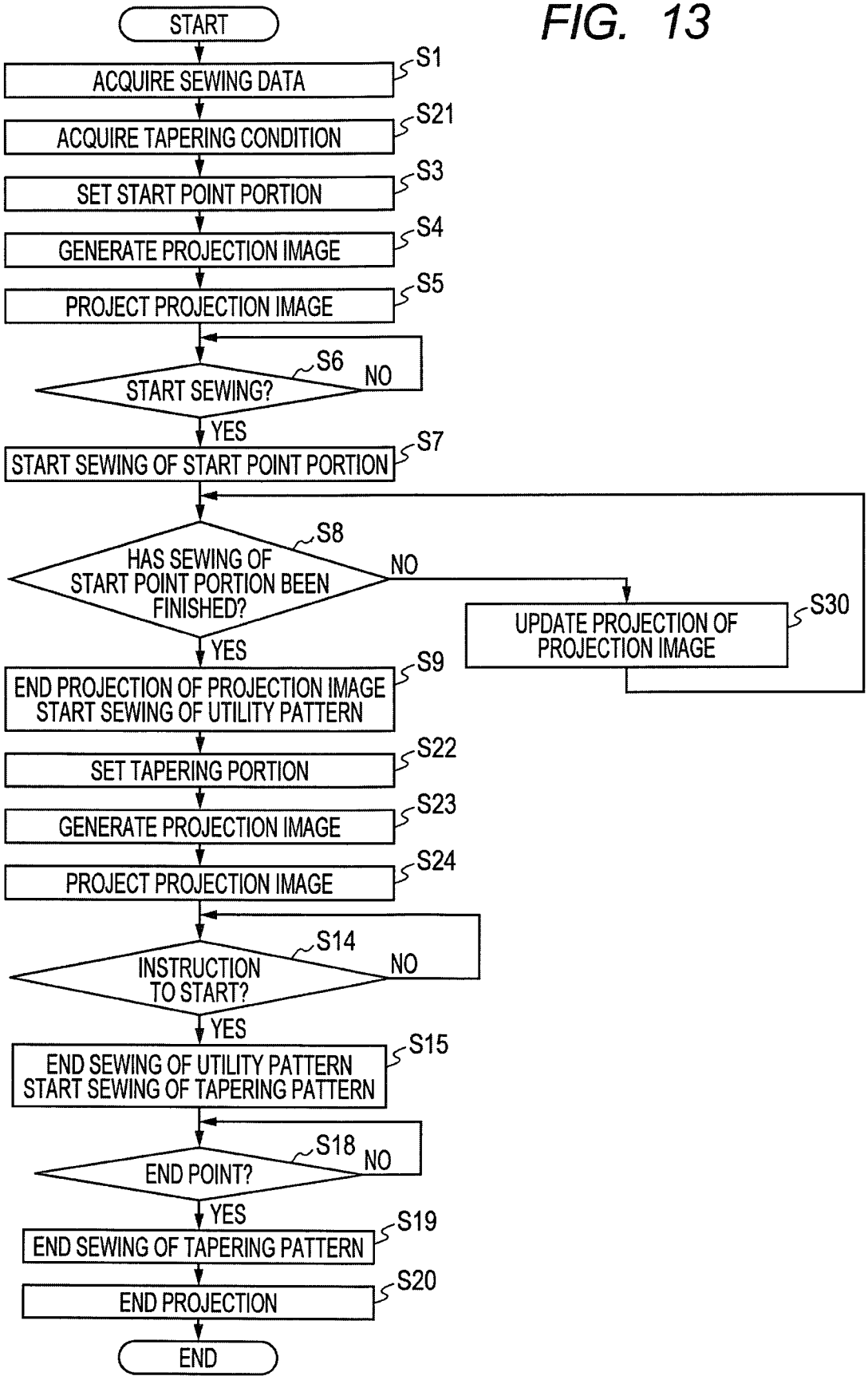
FIG. 13 is a flowchart of a main process.

A main process of a third modification will be described with reference to FIG. 13. In FIG. 13, the same processes as those in the main process of the second modification of FIGS. 10A and 10B are denoted by the same reference numerals. As shown in FIG. 13, the main process of the third modification is different from the main process of the second modification in that the processing of S16 and S25 to S29 is omitted. The sewing machine 1 of the third modification does not determine the timing to start sewing of the end point portion G6 based on the image capture result of the marker 110. The sewing machine 1 of the third modification may not include the image capturing device 57. The user inputs an instruction to start sewing of the end point portion G6 via the start-stop switch 29 based on the projection image projected in S24. The controller 2 continues to sew the utility pattern J and project the projection image set in S23 until the controller 2 detects an instruction to start sewing of the end point portion G6 (S14: NO). In response to detecting an instruction to start the sewing of the end point portion G6 (S14: YES), the controller 2 ends sewing of the utility pattern J, and starts sewing of the end point portion G6 that is the tapering pattern set in S22 (S15). In response to determining that the end point EP of the end point portion G6 has been sewn based on the number of stitches from the start of sewing of the end point portion G6 (S18: YES), the controller 2 ends the sewing of the end point portion G6 (S19) and ends projection of the projection image (S20).

In the sewing machine 1 of the above-described embodiment and the first to third modifications, the sewing machine 1, the controller 2, the needle bar 6, the needle plate 4, the bed 11, the feed dog 24, the start-stop switch 29, the sewing portion 30, the movement portion 31, the feeder 32, the swing motor 35, the image capturing device 57, and the projector 58 are examples of a sewing machine, a controller, a needle bar, a needle plate, a bed, a feed dog, an operation interface, a sewing portion, a movement portion, a feeder, an actuator, an image sensor, and a projector, respectively. The processing of S1 is an example of a sewing data acquisition process. The processing of S2 and S21 is an example of a condition acquisition process. The processing of S12 and S23 is an example of an image generation process. The processing of S9 is an example of a utility pattern sewing process. The processing of S13 and S24 is an example of a projection control process. The processing of S15 is an example of a tapering pattern sewing operation. The processing of S11 is an example of a marker detection process. The processing of S10 and S26 is an example of a capturing control process.

The sewing machine 1 of the above embodiment includes the bed 11, the projector 58, the sewing portion 30, the feeder 32, the movement portion 31, and the controller 2. The bed 11 includes the needle plate 4 and is configured such that the sewing workpiece C is placed thereon. The projector 58 is configured to project a projection image toward the bed 11. The sewing portion 30 includes the needle bar 6 to which the sewing needle 7 is attachable to a lower end thereof, and is configured to form stitches on the sewing workpiece C by moving the needle bar 6 in the upper-lower direction. The feeder 32 includes the feed dog 24 and is configured to feed the sewing workpiece C in the front-rear direction with respect to the needle bar 6. The movement portion 31 includes the swing motor 35, and is configured to move the needle bar 6 in the left-right direction crossing the front-rear direction with respect to the needle plate 4 using the power of the swing motor 35. The controller 2 is configured to control the projector 58, the sewing portion 30, the feeder 32, and the movement portion 31. The controller 2 acquires sewing data for continuously forming a utility pattern in the front-rear direction, the utility pattern including stitches that cross the front-rear direction (S1). The controller 2 acquires a condition for sewing a tapering pattern including a tapering portion obtained by deforming the utility pattern so as to be tapered toward one side in the front-rear direction (S2, S21). The controller 2 generates a projection image representing the tapering pattern based on the sewing data acquired in S1 and the condition acquired in S2 or S21 (S12, S23). The controller 2 controls the sewing portion 30, the feeder 32, and the movement portion 31 in accordance with the sewing data to continuously sew the utility pattern in the front-rear direction (S9). After starting sewing the utility pattern in S9, the controller 2 controls the projector 58 to project the projection image at the planned sewing position of the tapering pattern in the planned sewing size (S13, S24). After starting projection of the projection image in S13 or S24, the controller 2 controls the sewing portion 30, the feeder 32, and the movement portion 31 in accordance with the sewing date acquired in S1 and the conditions acquired in S2 or S21 to sew the tapering pattern continuous with the utility pattern (S15). After starting sewing of the utility pattern (S9), the controller 2 of the sewing machine 1 projects the projection image representing the tapering pattern at the planned sewing position on the sewing workpiece C in the planned sewing size (S13, S24). Thus, after the sewing of the utility pattern is started, the user of the sewing machine 1 grasps the planned sewing position and the size of the tapering pattern that is sewn continuously with the utility pattern before the sewing of the tapering pattern is started. The processing of S13 and S24 performed by the sewing machine 1 contributes to reducing a possibility that the tapering pattern is sewn at a position that is not intended by the user.

The sewing machine 1 includes the start-stop switch 29 that receives a starting instruction to start sewing of the tapering pattern after starting projection of the projection image in S13 and S24. In response to the start-stop switch 29 receiving the starting instruction (S14: YES), the controller 2 performs sewing of the tapering pattern (S15). The sewing machine 1 starts sewing of the tapering pattern at the timing at which the user inputs the starting instruction based on the projection image projected onto the sewing workpiece C. The start-stop switch 29 of the sewing machine 1 contributes to improving a possibility of sewing the tapering pattern at the position intended by the user when the user manually inputs the starting instruction.

The controller 2 generates the projection image representing the tapering pattern including only the end point portion which is the tapering portion (S12 and S23). The sewing machine 1 projects the projection image that represents only the tapering portion and represents the tapering pattern that does not include the utility pattern. Thus, the user grasps the tapering portion to be formed, before starting the sewing. The controller 2 of the sewing machine 1 contributes to improving a possibility of sewing the tapering portion having stitches intended by the user.

The controller 2 generates the projection image including line segments representing the stitches of the tapering pattern in S12 and S23. Thus, the sewing machine 1 contributes to the user grasping an image of the stitches to be formed on the sewing workpiece C before starting the sewing of the tapering pattern.

The controller 2 generates the projection image that represents the figure (a triangle, a pentagon, and so on) indicating the formation range of the stitches of the tapering pattern in S12 and S23. The sewing machine 1 projects the projection image representing the figure indicating the formation range of the stitches of the tapering pattern onto the sewing workpiece C, which allows the user to easily check the formation range of the stitches in addition to the planned sewing position and the size of the tapering pattern even if the shape of the tapering pattern is complicated.

The condition in the main process of the second and third modifications includes the length of the tapering portion in the front-rear direction (forming direction). In S23, the controller 2 generates the projection image representing the tapering pattern including the tapering portion having the length in the forming direction included in the condition. The condition of the sewing machine 1 of the second and third modifications contributes to improving the convenience of the user when setting the length in the forming direction, compared with a case in which the length in the forming direction of the tapering portion is not specified in advance.

The controller 2 of the second modification detects the position of the marker 110 on the sewing workpiece C (S27). When the distance from the center point 111 of the marker 110 to the current needle drop point has become the length in the front-rear direction (S28: YES), the controller 2 starts sewing of the tapering pattern (S15). The processing of S27 by the controller 2 of the second modification contributes to automatically setting the timing to start sewing of the tapering pattern based on the detection result of the marker 110.

The controller 2 of the above-described embodiment detects the position of the marker 110 on the sewing workpiece C (S11). The controller 2 generates the projection image representing the tapering pattern including the tapering portion having the length in the forming direction corresponding to the distance between the position of the current needle drop point and the detected position of the marker 110 (S12). The controller 2 controls the projector 58 to project the projection image at the position defined by the current needle drop point and the center point 111 of the marker 110 (S13). The sewing machine 1 allows the user to, by checking the projection image, confirm the shape in a case where the tapering portion corresponding to the length from the position of the needle drop point to the position of the marker 110 is sewn, before starting the sewing of the tapering pattern.

The controller 2 of the above-described embodiment and the first and second modifications sets the end point of the tapering pattern at the position of the center point 111 of the marker 110, and sews the tapering pattern (S15). The controller 2 of the sewing machine 1 contributes to the user setting the position of the end point of the tapering pattern by using the marker 110.

The sewing machine 1 of the above-described embodiment and the first and second modifications includes the image capturing device 57 configured to capture an image of the capturing region P that is a region including the lower side of the needle bar 6. The controller 2 acquires the captured image captured by the image capturing device 57 (S10). The controller 2 of the embodiment and the first modification analyzes the captured image in S11 and detects the position of the marker 110 on the sewing workpiece C. The controller 2 of the sewing machine 1 of the embodiment and the first modification contributes to setting the length in the forming direction of the tapering pattern based on the position of the marker 110 on the sewing workpiece C detected from the captured image. The controller 2 of the second modification analyzes the captured image in S27, and detects the position of the marker 110 on the sewing workpiece C. The controller 2 of the sewing machine 1 of the second modification sets the timing to start the sewing of the tapering pattern based on the position of the marker 110 on the sewing workpiece C detected from the captured image.

While the present disclosure has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the present disclosure, and not limiting the present disclosure. Various changes may be made without departing from the spirit and scope of the disclosure. Thus, the disclosure is intended to embrace all known or later developed alternatives, modifications, variations, improvements, and/or substantial equivalents. Some specific examples of potential alternatives, modifications, or variations in the described disclosure are provided below.

(A) The configuration of the sewing machine 1 may be changed as appropriate. The sewing machine 1 may be an industrial sewing machine. Each of the first direction and the second direction may be changed in accordance with the configuration of the sewing machine 1, as long as it is bidirectional. The feeder 32 may include a motor that drives the feed dog 24 to move the sewing workpiece C in the left-right direction. In this case, the swing motor 35 and the swing mechanism 36 may be omitted as appropriate, and the sewing machine 1 may sew the utility pattern and the tapering pattern by moving the sewing workpiece C in the front-rear direction (the feed direction) and the left-right direction (the movement direction) using the feed dog 24. The input interface may be the touch panel 26, a keyboard, a mouse, a joystick, and so on, in addition to or instead of the start-stop switch 29. The display may be, for example, an organic EL display, a plasma display, a plasma tube array display, or an electronic paper display using electrophoresis and so on, that are configured to display an image. The display may be omitted as necessary. The projection method, the attachment position, the projection region M, and so on of the projector 58 may be changed as appropriate. The colors that are displayable by the projector 58 may be changed. The capturing method, the attachment position, the capturing region P, and so on of the image capturing device 57 may be changed as appropriate. The storage device (memory) may be any readable and writable removable media such as magnetic disks, magneto-optical disks, optical disks, or semi-conductor memories, or may be non-portable storage devices such as built-in hard disk drives or SSDs (Solid State Drive), in addition to or instead of the memory 84. The utility pattern may be a pattern that includes stitches crossing the front-rear direction, which is the direction in which the sewing workpiece C is fed by the feed dog 24, and that is sewn continuously and repeatedly in the front-rear direction. The utility pattern may be acquired from another device (for example, a storage medium such as a USB memory, a smartphone, a tablet PC, a PC, and so on) connected to the sewing machine 1 with wired or wireless communication, or may be input by the user operating the touch panel 26. The power of the movement portion 31 may be a solenoid, a power cylinder, and so on, in addition to or instead of the swing motor 35.

The configuration of the marker 110 may be changed as appropriate. The method of detecting the marker 110 may be changed depending on the configuration of the marker 110. The position of the marker 110 may be changed as appropriate depending on the configuration of the marker 110. The marker 110 may be an ultrasonic wave generator, and the sewing machine 1 may include an ultrasonic wave receiver and may detect the marker 110 by receiving an ultrasonic wave generated by the marker 110. The marker 110 may be a magnetic body, and the sewing machine 1 may include a magnetic sensor and may detect the marker 110 based on a detection result of the magnetic sensor. The controller 2 may display at least part of the captured image captured by the image capturing device 57 on the LCD 15, and the user may indicate the position of the marker 110 in the captured image displayed on the LCD 15 by a panel operation. In this case, the controller 2 may detect the position of the marker 110 in the captured image based on the panel operation detected by the touch panel 26. The image capturing device 57 may be omitted as appropriate depending on the configuration of the marker 110. The marker 110 may be provided on a head of a pin. The marker 110 may be a figure that is written on the sewing workpiece C with a tailor's chalk and so on. In this case, the sewing machine 1 may omit the stopping process of S17 or the deceleration process of S29 for peeling off the marker 110 from the sewing workpiece C.

(B) The program including the command for performing the main process of FIGS. 4A, 4B, 10A, 10B and 13 may be stored in a storage device (memory) of the sewing machine 1 by the time when the controller 2 performs the program. Thus, each of the acquisition method of the program, the acquisition path, and a device storing the program may be appropriately changed. The program performed by the controller 2 may be received from another device via a cable or wireless communication and stored in a storage device such as a flash memory. The other device includes, for example, a PC and a server connected via a network.

(C) Each step of the main process of the sewing machine 1 is not limited to being performed by the controller 2, and some or all of the steps may be performed by another electronic device (for example, an ASIC). Each step of the main process may be processed in a distributed manner by a plurality of electronic devices (for example, a plurality of CPUs). The order of the steps of the main process may be changed, and some steps may be omitted or added as necessary. A mode in which an operating system (OS) and so on that is operating on the sewing machine 1 performs a part or all of the main process based on a command from the controller 2 is also included in the scope of the present disclosure. For example, the following modifications may be appropriately made to the main process.

The controller 2 of the above-described embodiment may not incline the forming direction of the end point portion in S12 with respect to the front-rear direction which is the feed direction of the sewing workpiece C by the feed dog 24. A method of setting the position of the end point EP of the marker 110 in S12 may be changed as appropriate. The controller 2 may set the end point EP of the end point portion to a position separated from the center point 111 of the marker 110 by a particular distance in a particular direction, or may set the end point EP of the end point portion to a position of the intersection of a straight line passing through the center point 111 of the marker 110 and extending in the left-right direction and a straight line passing through the current needle drop point and extending in the front-rear direction. The controller 2 may not incline the forming direction of the end point portion in S12 with respect to the front-rear direction which is the feed direction of the sewing workpiece C by the feed dog 24. In the above-described embodiment (FIGS. 4A and 4B), the processing of S14 may be omitted. In this case, the controller 2 may perform sewing of the tapering pattern based on the detection result of the marker 110 (S15). The controller 2 may end projection of the projection image in S15.

In the second modification (FIGS. 10A and 10B), the processing of S14 may be omitted. In this case, after S24, the controller 2 may perform detection of the marker 110 (S26, S27) without waiting for a starting instruction by the user, and proceed to the processing (S15) of sewing the tapering pattern based on the detection result.

The condition acquired in S2 or S21 may be changed as appropriate. The shape of the tapering portion may be selectable from some of the right-tapered shape, the center-tapered shape, and the left-tapered shape. The shape of the tapering portion may be not selectable. The shape of the tapering portion may be other than the three types described above. The controller 2 may acquire the length of the utility pattern between the start point portion and the end point portion in S2 or S21. In this case, after starting the sewing of the utility pattern J, the controller 2 may generate a projection image representing a tapering pattern including an end point portion in a case where the end point portion is sewn after the utility pattern J of the acquired length is sewn, and project the generated projection image. In this case, the user can check whether the tapering pattern is sewn at the desired position based on the projection image before starting the sewing of the tapering pattern. The figure indicating the formation range of the stitches of the tapering pattern may be changed as appropriate in accordance with the shape of the tapering pattern. The tapering pattern TP may not include the start point portion G1. The controller 2 may generate a projection image representing a tapering pattern in a predetermined form in S12 or S23. The controller 2 may select the shape of the projection image representing the start point portion G1 in the same manner as the end point portion, and may generate the projection image in the selected shape in S4. The controller 2 may appropriately omit a part or all of the processing for sewing the start point portion G1 in S3 to S8 and S30. The number of stitches per unit length in the feed direction (the thread density in the feed direction) of the start point portion and the end point portion may be different from the number of stitches per unit length in the feed direction of the utility pattern that is continuous with the start point portion or the end point portion. The above-described modifications may be appropriately combined within a range in which no contradiction occurs.

What is claimed is:

1. A sewing machine comprising:

a bed including a needle plate, the bed being configured such that a sewing workpiece is placed thereon;

a projector configured to project a projection image toward the bed;

a needle bar configured that a sewing needle is attachable to a lower end of the needle bar, the needle bar being movable up and down to form stitches on the sewing workpiece;

a feed dog configured to feed the sewing workpiece in a first direction relative to the needle bar;

an actuator configured to move the needle bar in a second direction relative to the needle plate, the second direction crossing the first direction; and a controller configured to:

acquire sewing data for forming a utility pattern continuously in the first direction, the utility pattern including stitches crossing the first direction;

acquire a condition for sewing a tapering pattern including a tapering portion, the tapering portion being obtained by deforming the utility pattern to be tapered toward one side in the first direction;

generate the projection image representing the tapering pattern, based on the sewing data and the condition;

control the needle bar, the feed dog, and the actuator in accordance with the sewing data to sew the utility pattern continuously in the first direction;

after starting sewing of the utility pattern, control the projector to project the projection image at a planned sewing position of the tapering pattern in a planned sewing size; and perform a tapering pattern sewing operation of, after starting projection of the projection image, controlling the needle bar, the feed dog, and the actuator in accordance with the sewing data and the condition to sew the tapering pattern that is continuous with the utility pattern.

2. The sewing machine according to claim 1, further comprising an operation interface configured to, after starting projection of the projection image, receive a starting instruction for starting sewing of the tapering pattern, wherein the controller is configured to perform the tapering pattern sewing operation in response to receiving the starting instruction by the operation interface.

3. The sewing machine according to claim 1, wherein the controller is configured to generate the projection image representing the tapering pattern including the tapering portion and not including the utility pattern.

4. The sewing machine according to claim 1, wherein the controller is configured to generate the projection image including line segments representing stitches of the tapering pattern.

5. The sewing machine according to claim 1, wherein the controller is configured to generate the projection image representing a figure indicating a formation range of stitches of the tapering pattern.

6. The sewing machine according to claim 1, wherein the condition includes a length of the tapering portion in the first direction; and wherein the controller is configured to generate the projection image representing the tapering pattern including the tapering portion having the length in the first direction.

7. The sewing machine according to claim 6, wherein the controller is configured to:

detect a position of a marker on the sewing workpiece; and start the tapering pattern sewing operation in response to determining that a distance between the position of the marker and a position of a current needle drop point becomes the length in the first direction.

8. The sewing machine according to claim 1, wherein the controller is configured to:

detect a position of a marker on the sewing workpiece;

generate the projection image representing the tapering pattern including the tapering portion having a length in the first direction, the length in the first direction being a length based on a position of a current needle drop point and the position of the marker; and project the projection image at a position defined by the position of the current needle drop point and the position of the marker.

9. The sewing machine according to claim 8, wherein the controller is configured to:

set an end point of the tapering pattern at the position of the marker and sew the tapering pattern.

10. The sewing machine according to claim 7, further comprising an image sensor configured to capture an image of a capturing region including an area below the needle bar, wherein the controller is configured to:

acquire a captured image captured by the image sensor; and analyze the captured image to detect the position of the marker on the sewing workpiece.

11. The sewing machine according to claim 1, further comprising a user interface configured to display input keys for selecting a shape of the tapering portion and to receive selection of one of the input keys, the condition including the shape of the tapering portion, the input keys including:

a right-tapering input key for specifying a right-tapered shape as the shape of the tapering portion;

a center-tapering input key for specifying a center-tapered shape as the shape of the tapering portion;

a left-tapering input key for specifying a left-tapered shape as the shape of the tapering portion; and a no-tapering input key for specifying not setting the tapering portion.

12. The sewing machine according to claim 9, wherein the controller is configured to:

determine whether a distance from the current needle drop point to the end point of the tapering pattern is smaller than a threshold; and in response to determining that the distance from the current needle drop point to the end point of the tapering pattern is smaller than the threshold, control the needle bar, the feed dog, and the actuator to temporarily stop or decelerate sewing of the tapering pattern and output a message for prompting removal of the marker from the sewing workpiece.

* * * * *